US008734035B2

(12) United States Patent
Suva et al.

(10) Patent No.: US 8,734,035 B2
(45) Date of Patent: May 27, 2014

(54) MEDIA CARTRIDGE WITH SHIFTING RIBS

(75) Inventors: Alan J. Suva, Milwaukee, WI (US); Richard L. Carriere, Oak Creek, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 313 days.

(21) Appl. No.: 12/845,859

(22) Filed: Jul. 29, 2010

(65) Prior Publication Data

US 2012/0027485 A1 Feb. 2, 2012

(51) Int. Cl.
*B41J 15/04* (2006.01)

(52) U.S. Cl.
CPC ..... *B41J 15/044* (2013.01)
USPC ..... 400/211; 400/613

(58) Field of Classification Search
CPC ..... B41J 31/12
USPC ..... 400/613, 207, 194, 196, 211, 619; 242/338.4
IPC ..... B41J 31/12, 15/06, 2/315, 35/28
See application file for complete search history.

(56) References Cited

U.S. PATENT DOCUMENTS

| | | | | |
|---|---|---|---|---|
| 2,331,331 | A | 10/1943 | Lambert | |
| 4,337,001 | A | 6/1982 | Cappotto | |
| 4,615,628 | A | 10/1986 | Swinburne | |
| 4,802,633 | A | 2/1989 | Beery | |
| 4,988,224 | A | 1/1991 | Furrow et al. | |
| 5,211,491 | A | 5/1993 | Harvey | |
| 6,406,202 | B1 * | 6/2002 | Unno et al. | 400/613 |
| 6,485,206 | B1 * | 11/2002 | Takahashi | 400/207 |
| 6,520,696 | B2 * | 2/2003 | Huss et al. | 400/208 |
| 7,234,884 | B1 | 6/2007 | Tratar | |
| 2004/0190971 | A1 * | 9/2004 | Tanaka | 400/615.2 |
| 2009/0196669 | A1 * | 8/2009 | Murata | 400/207 |

FOREIGN PATENT DOCUMENTS

| | | | | |
|---|---|---|---|---|
| JP | 2000177221 | * | 6/2000 | B41J 32/00 |
| KR | 300329170 | | 7/2003 | |
| WO | 03072366 A1 | | 9/2003 | |

* cited by examiner

*Primary Examiner* — Daniel J Colilla
*Assistant Examiner* — Ruben Parco, Jr.
(74) *Attorney, Agent, or Firm* — Quarles & Brady LLP

(57) ABSTRACT

A media cartridge is disclosed for insertion into a cartridge receptacle of a printer. The media cartridge includes a cartridge housing having one or more shifting ribs on the cartridge housing. At a position of initial insertion of the media cartridge into the cartridge receptacle, the shifting ribs are configured to center a length of media and an ink ribbon of the media cartridge between a print head and a platen roller in the cartridge receptacle. As the insertion of the media cartridge into the cartridge receptacle continues, the shifting ribs shift the length of media and the ink ribbon toward one of the print head and the platen roller.

6 Claims, 15 Drawing Sheets

FIG. 20
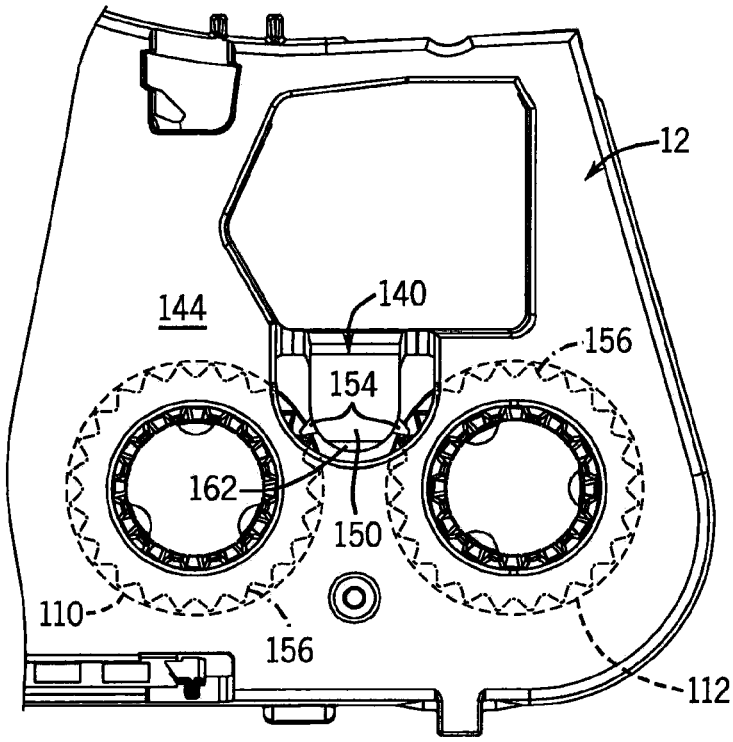
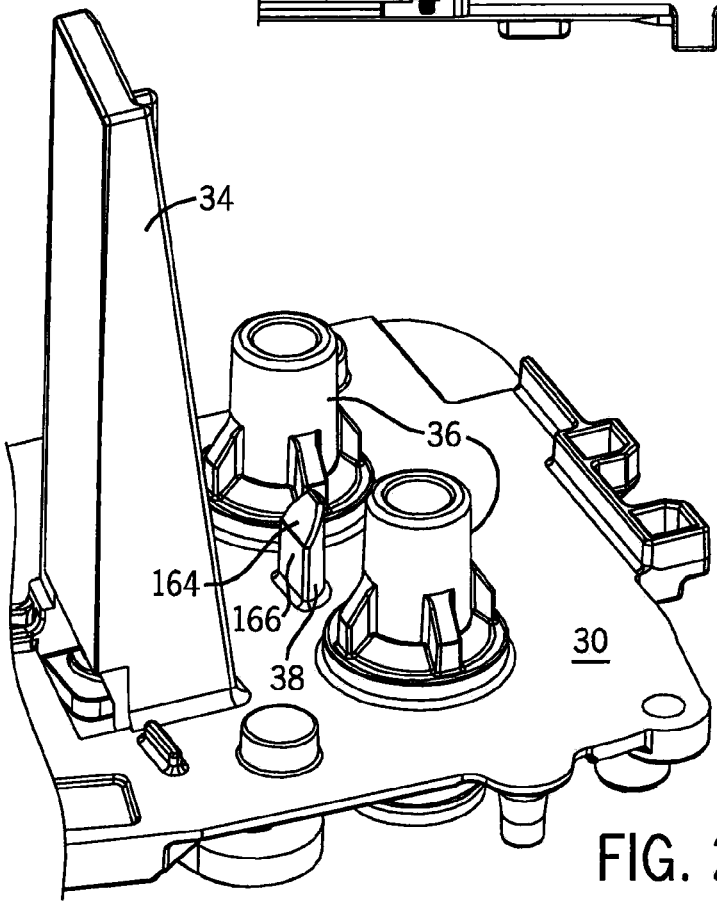
FIG. 21

MEDIA CARTRIDGE WITH SHIFTING RIBS

CROSS-REFERENCE TO RELATED APPLICATIONS

Not applicable.

STATEMENT OF FEDERALLY SPONSORED RESEARCH OR DEVELOPMENT

Not applicable.

BACKGROUND OF THE INVENTION

This disclosure relates to a media cartridge for a printer. In particular, this disclosure relates to improvements in the loading of the media cartridge into the printer.

Many printers are designed to receive cartridges that provide a length of media for printing. These media cartridges are often constructed so that a leading end of the media is pre-positioned for insertion between the components of the printing mechanism (e.g., the print head and platen roller) during the loading of the cartridge into the printer. This type of positioning of the media during the loading of the cartridge is generally preferable to, for example, requiring a user to manually thread an end of the media between the printing components in a cartridge-less type construction.

Even with this pre-positioning of the media, it is possible that during loading something may go wrong. Typically, as cartridge is loaded into a cartridge receptacle of the printer, the leading end of the media is blindly inserted between the printing components in a direction perpendicular to the printing direction. Accordingly, there is the possibility that the media and/or an ink ribbon that runs parallel to the media will snag on a printer component. If either the media or the ink ribbon catch on the printer components, then the media or the ink ribbon may be damaged, tear, or crumple. Further, if the media or ink ribbon catch on the print head, then it is possible that the print head itself could be damaged. Ultimately, this may degrade print quality, jam the feeding of the media or ribbon, or, even worse, damage the printer.

Hence, a need exists for an improved media cartridge. In particular, there is a need for a media cartridge with improved placement of the media and/or ribbon with respect to the printing components.

SUMMARY OF THE INVENTION

A media cartridge is disclosed for insertion into a cartridge receptacle of a printer in which the cartridge receptacle has a print head and a platen roller located therein. The media cartridge includes a cartridge housing having at least one shifting rib on a side wall of the cartridge housing. The shifting rib(s) are configured to center a length of media and an ink ribbon of the media cartridge between the print head and the platen roller in the cartridge receptacle at a position of initial insertion of the media cartridge into the cartridge receptacle. As insertion of the media cartridge into the cartridge receptacle continues, the shifting rib(s) are configured to shift the length of media and the ink ribbon toward one of the print head and the platen roller.

In some forms, during an insertion of the media cartridge into the cartridge receptacle, the shifting rib(s) may cause a rotation and/or a translation of the media cartridge within the cartridge receptacle.

In some forms, the centering the length of media and the ribbon at the position of initial insertion may thereby inhibit contact of the length of media and the ink ribbon with the print head and the platen roller. Among other things, centering the media and ink ribbon may prevent interference of the media and ink ribbon with the components of a printer and therefore reduces the likelihood of the media or ink ribbon being snagged and/or damaged.

In another form, the shifting ribs may include a first shifting rib on one side of the cartridge housing and a second shifting rib on an opposing side of the cartridge housing. The first shifting rib may be a tab configured to engage a corresponding slot formed at a lower end of a wall of the cartridge receptacle. During insertion, an interaction of the tab with the wall of the cartridge receptacle above the slot may initially center the length of media and the ribbon between the platen roller and the print head before the tab engages the slot. After a position of insertion at which the tab engages the slot, an engagement of the tab with the slot may permit the shifting of the length of media and the ribbon toward one of the print head and the platen roller. The second shifting rib may be an angled rib configured for engagement with a wall of the cartridge receptacle. Upon insertion, engagement of the angled rib with the wall of the cartridge receptacle may shift the length of media and the ink ribbon toward one of the print head and the platen roller. The second shifting rib may be configured to not bias the length of media and ribbon toward one of the print head and the platen roller until the first shifting rib engages the slot.

In still another form, the length of media may be at least partly contained within the cartridge housing and may have a free end extending from an exit opening of the cartridge housing. The free end may extend from the exit opening to a front guide of the cartridge housing to thereby define a media path therebetween. The length of media may be wrapped around a core to form a roll and have a free end extending from the roll, through the exit opening, and to the front guide. The ribbon may extend between a pair of spools supported by the housing and have a segment that runs parallel to the length of media along the media path. The cartridge housing may be shaped to receive the print head of the printer during insertion of the media cartridge into the cartridge receptacle such that the print head is located proximate the media path.

A printer assembly is also disclosed. The printer assembly includes a media cartridge and a printer having a cartridge receptacle with a print head and a platen roller located therein. The media cartridge is loaded into the cartridge receptacle of the printer. The media cartridge includes a cartridge housing having an exit opening and a front guide, a length of media supported by the cartridge housing and having a portion that extends from the exit opening to the front guide along a media path, an ink ribbon supported by the cartridge housing and having a portion that runs parallel to the length of media along the media path, and at least one shifting rib formed on the cartridge housing. The shifting rib(s) center a length of media and an ink ribbon between the print head and the platen roller in the cartridge receptacle at a position of initial insertion of the media cartridge into the cartridge receptacle. When loaded into the cartridge receptacle, the shifting rib(s) shift the length of media and the ink ribbon toward one of the print head and the platen roller.

In some forms of the printer assembly, the shifting rib(s) may include a tab that engages a corresponding slot formed at a lower end of a wall of the cartridge receptacle. During insertion, an interaction of the tab with the wall of the cartridge receptacle above the slot may initially center the length of media and the ink ribbon between the platen roller and the print head before the tab engages the slot. After a position of insertion at which the tab engages the slot, an engagement of the tab with the slot may permit shifting of the length of media and the ribbon toward one of the print head and the platen roller.

In another form of the printer assembly, one of the print head and the platen roller may be movable and the other may be fixed. By having one movable and one fixed, once the media cartridge is loaded into the cartridge receptacle, the movable one of the print head and the platen roller may be moved towards the fixed one of the print head and the platen roller to form a nip point.

Accordingly, a media cartridge and printer assembly are disclosed that offer improved loading of the media cartridge into a printer and, more specifically, minimizes the possibility of damage to either the media or the ink ribbon during loading. As will be described in further detail below, preventing damage to the media and ink ribbon is achieved by placing shifting rib(s) on the media cartridge that direct the cartridge in such a manner as to avoid snagging or catching the media and ribbon on the printer components (i.e., the print head, the platen roller, the heat sink, etc.) during loading.

Further, the shifting rib(s) are structured in such a manner as to cause the gradual shifting of the cartridge into place during loading. This means that the movement initiated by the shifting rib(s), which may be translational, rotational, or both, is not greatly noticed by the end user during the process of insertion.

These and still other advantages of the invention will be apparent from the detailed description and drawings. What follows is merely a description of a preferred embodiment of the present invention. To assess the full scope of the invention, the claims should be looked to as the preferred embodiment is not intended to be the only embodiment within the scope of the claims.

BRIEF DESCRIPTION OF THE DRAWINGS

FIG. 20 is a bottom view showing the un-flexed ribbon lock member engaging the teeth of the ink ribbon spools;

FIG. 21 is a detailed perspective view of a portion of the cartridge receptacle illustrating the unlocking post and the ribbon drive spindles;

DETAILED DESCRIPTION OF THE PREFERRED EMBODIMENT

Figure 1:
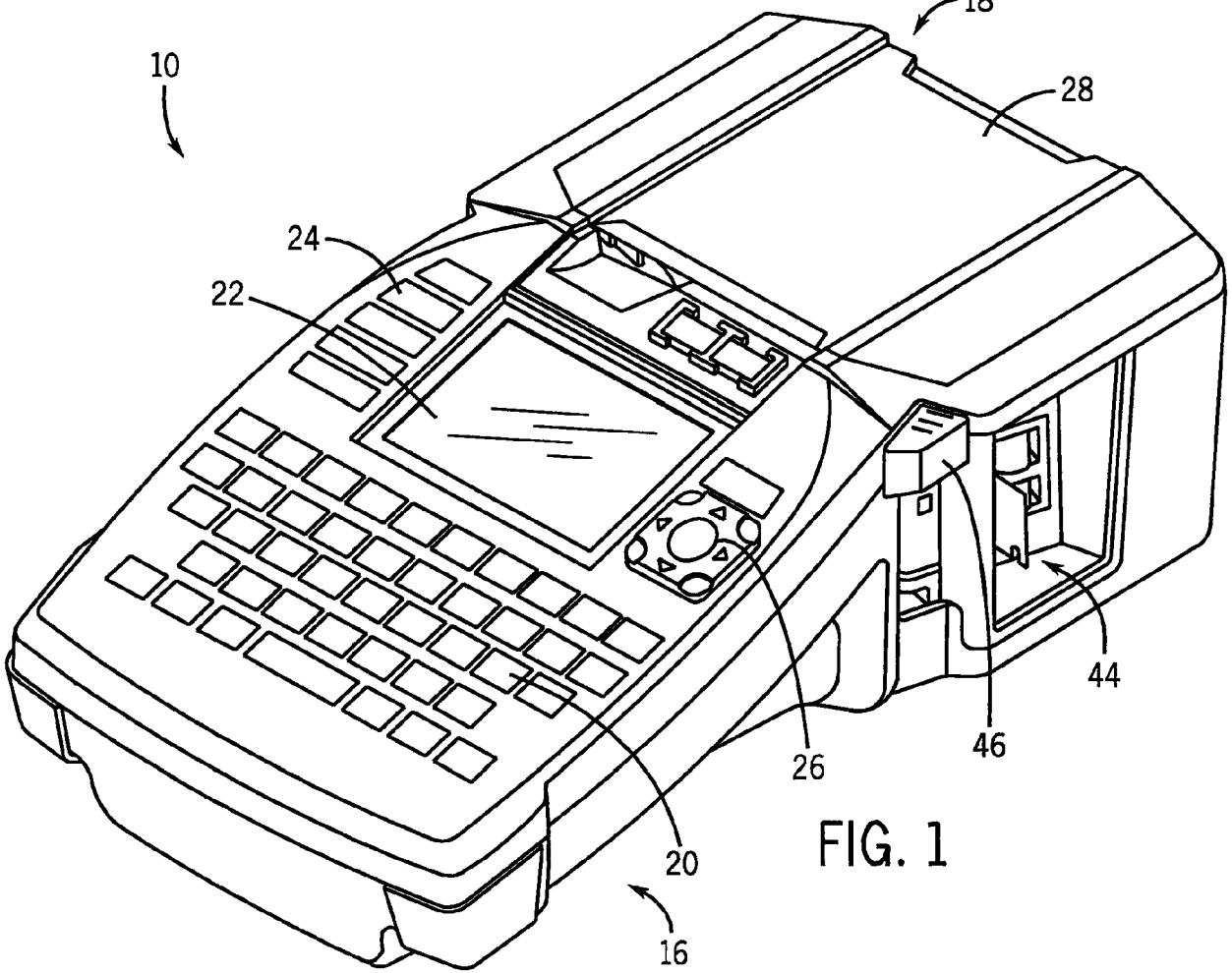
FIG. 1 is a perspective view of a printer.
Figure 2:
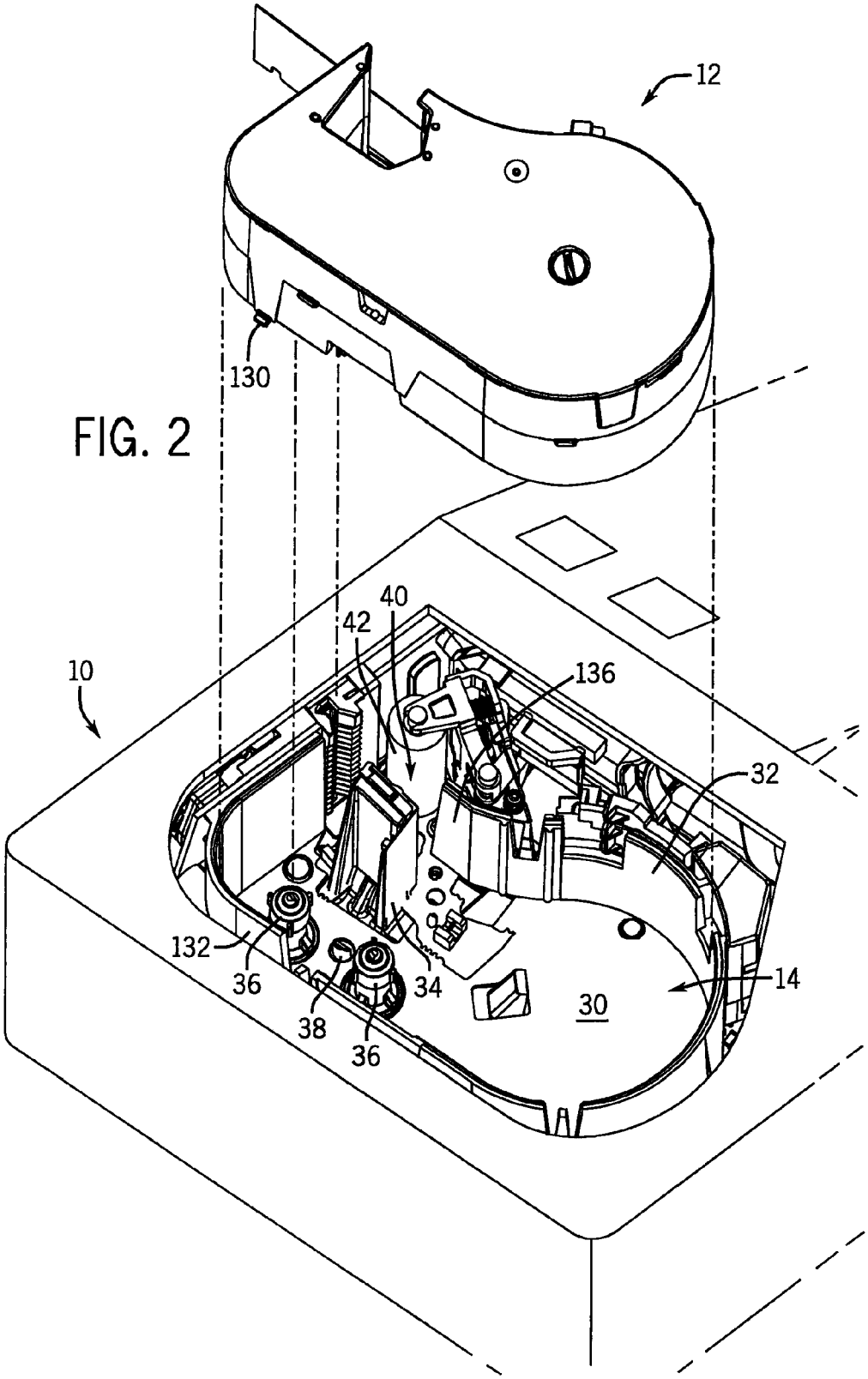
FIG. 2 is a perspective view of the printer with a media cartridge exploded therefrom.
Figure 3:
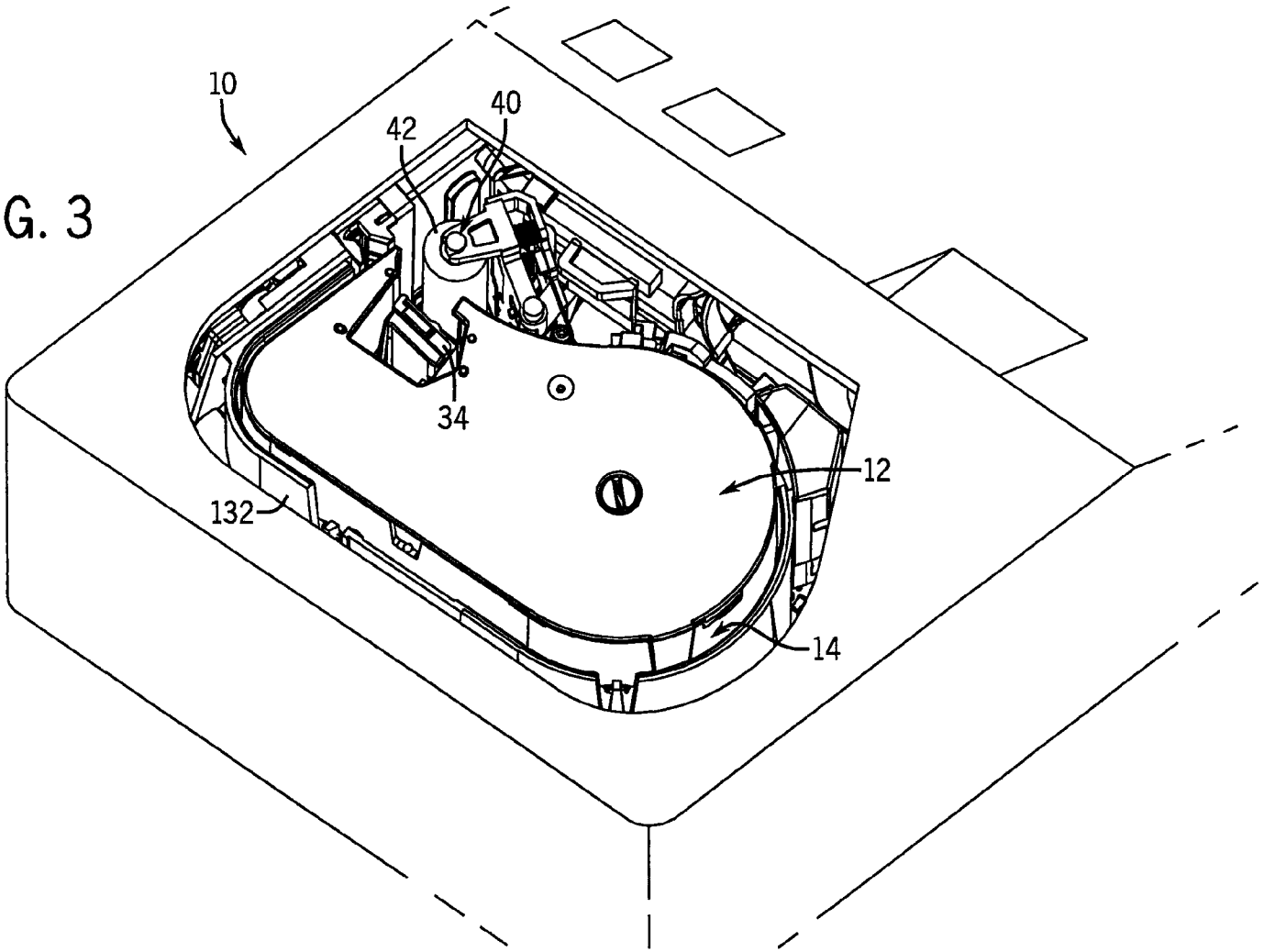
FIG. 3 is a perspective view of a printer with the media cartridge inserted or loaded therein.

Referring first to FIG. 1, a printer 10 is shown. The printer 10 is of a type that is a portable handheld printer for use at any of a number of locations and can also be placed on a table top for stationary use. In FIGS. 2 and 3, the printer 10 is shown receiving a media cartridge 12 in a cartridge receptacle 14 of the printer 10. Those having ordinary skill in the art will appreciate that although the printer 10 is shown as being a particular kind of printer, that the features described herein with respect to the media cartridge 12 and the printer 10 are applicable to any number of kinds of cartridge-receiving printers.

The printer 10 of FIG. 1 includes a body 16 with a head 18 located at one end thereof. The body 16 supports a number of items including a keypad 20 for the entry of data, a display 22 positioned between the keypad 20 and the head 18 of the printer 10, a row of buttons 24 on one lateral side of the display 22, and a navigational keypad 26 on the other lateral side of display 22. The display 22 is used to display information related to the operation of the printer 10 such as a user interface or a text string as it is entered by the user. The keypad 20, the row of buttons 24, and the navigational keypad 26 are all used for user entry of data into and/or control of the printer 10. Some of these controls may be dedicated to performing certain functions. For example, the row of buttons 24 may be used to select an item on a corresponding list of items displayed on the display 22 or may toggle the printer 10 between various operational modes.

The head 18 of the printer 10 includes a cover 28 which may be lifted or removed to provide access to the cartridge receptacle 14. As mentioned above, the cartridge receptacle 14 is configured to receive the media cartridge 12 and, accordingly, the cartridge receptacle 14 includes a number of printing and feeding components. Looking at FIG. 2 in which the media cartridge 12 is shown removed from the printer 10, the components in and around the cartridge receptacle 14 are clearly visible.

The cartridge receptacle 14 has a base wall 30 with generally perpendicular vertical walls 32 extending upwardly from the base wall 30. The vertical walls 32 have a shape which generally corresponds to the shape of the media cartridge 12. Of course, as the media cartridge 12 fits within the cartridge receptacle 14, the vertical walls 32 have a form slightly larger than the form of the media cartridge 12. This allows for the insertion of the media cartridge 12 in the cartridge receptacle 14 with some additional room for clearance.

A number of printer components are located in or about the cartridge receptacle 14 that will, in some way, interact with the media cartridge 12 upon the insertion of the media cartridge 12 into the cartridge receptacle 14. Extending upwardly from the base wall 30 there are various components including a thermal print head 34, ribbon drive spindles 36, and a deflection or unlocking post 38. Although not present in the form shown, in some printers, additional spindles may be present in the cartridge receptacle 14 that engage a roll of media to assist in the feeding of the media from the media cartridge.

On the vertical wall 32 of the cartridge receptacle 14 on the end proximate the body 16, an opening 40 is formed through which a platen roller 42 may be actuated. When no media cartridge 12 is in the cartridge receptacle 14, the platen roller 42 is retracted and spaced from the thermal print head 34 (as shown in FIG. 2). This spacing allows for easier insertion of the media and ink ribbon of the media cartridge 12 between platen roller 42 and the thermal print head 34 during the loading of the media cartridge 12 into the cartridge receptacle 14. Then, either during or after loading, the platen roller 42 is actuated towards the thermal print head 34 to establish a print line. In some printer constructions, the actuation of the platen roller 42 toward or away from the thermal print head 34 may be linked, mechanically or otherwise, to the insertion of the media cartridge 12 into the cartridge receptacle 14. During printing, the platen roller 42 will provide pressure along the print line such that, when the thermal print head 34 is heated, ink on the ink ribbon will be transferred to the print media.

A media exit 44 is found on the lateral side of printer 10, just past the thermal print head 34 and the platen roller 42. After the media is printed on, the media will be directed through this media exit 44 and to the exterior of the printer 10.

A depressible lever 46 is positioned proximate the media exit 44 on the exterior of the printer 10. This depressible lever 46 is linked to a cutting mechanism (not shown in detail) at the media exit 44. After a printer 10 has printed on a length of media, the printed media is directed through the media exit 44. At this point, the depressible lever 46 may be used to actuate the cutting mechanism so that the printed portion of the media is severed.

Figure 9:
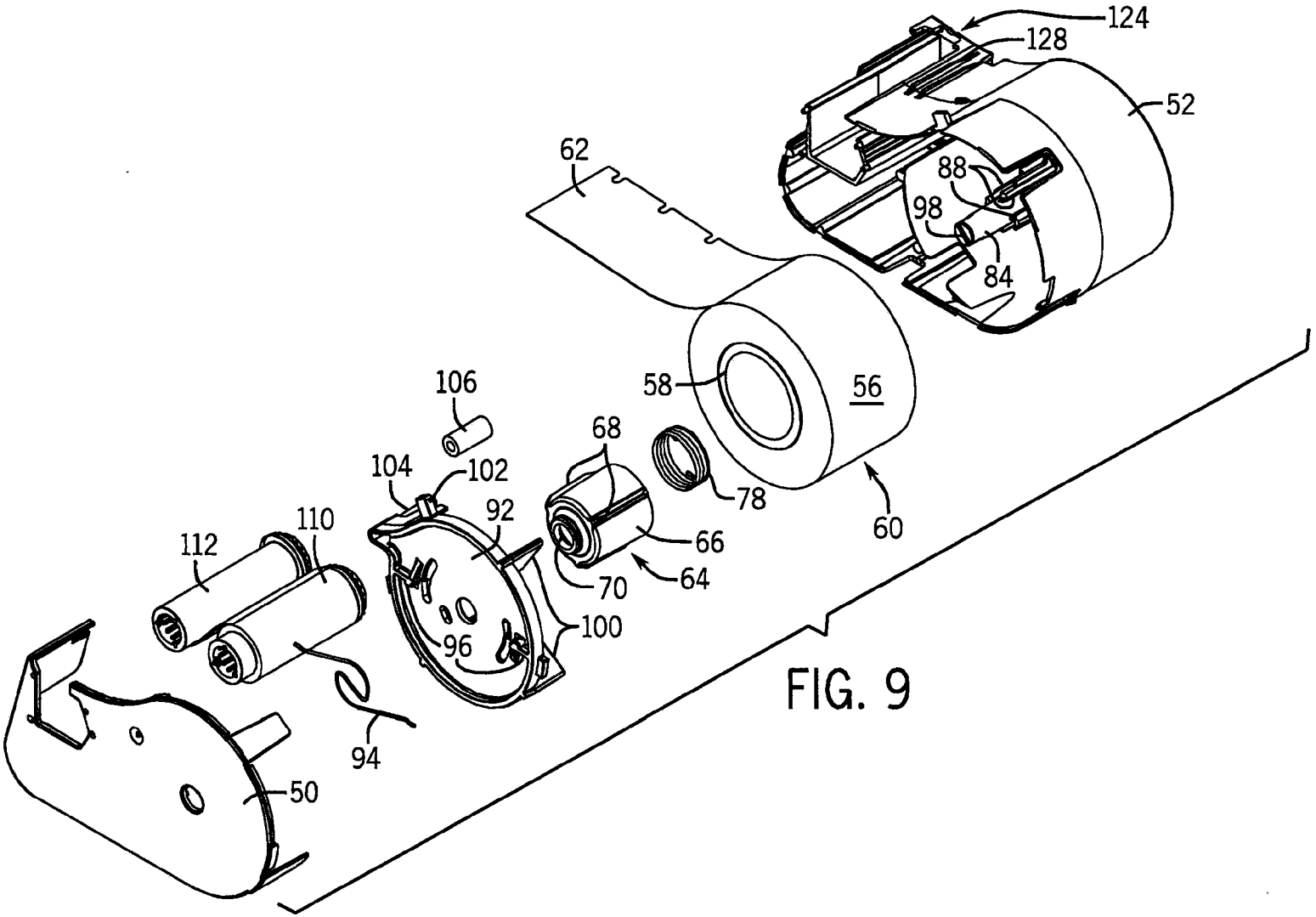
FIG. 9 is an exploded view of the media cartridge.

Now with additional reference to FIGS. 4 through 11, the media cartridge 12 is shown separate from the printer 10. The media cartridge 12 includes a housing 48 including a top housing portion 50 and a bottom housing portion 52 which are joined to form an internal cavity 54. As best illustrated in FIG. 9, in which the media cartridge 12 is shown in an exploded form, the internal cavity 54 of media cartridge 12 houses various components.

The various components housed in the internal cavity 54 of the housing 48 include a length of media 56 wrapped around a tubular central core 58 that forms a roll of media 60 with a free end 62 extending therefrom. The length of media 56 may be any of various kinds of media including, for example, paper, adhesive labels, and so forth. In some forms, the length of media 56 may be a continuous unbroken length that can be cut using a guillotine cutter or the like at the media exit 44 of the printer 10. In other forms, there may be perforations formed along the length of media 56 so that, after printing, the printed portion of the media may be separated from the length of media 56. It will be appreciated that while the length of media 56 is shown in the form of a roll, that the length of media 56 might be otherwise arranged within the media cartridge 12 for dispensing.

Figure 11:
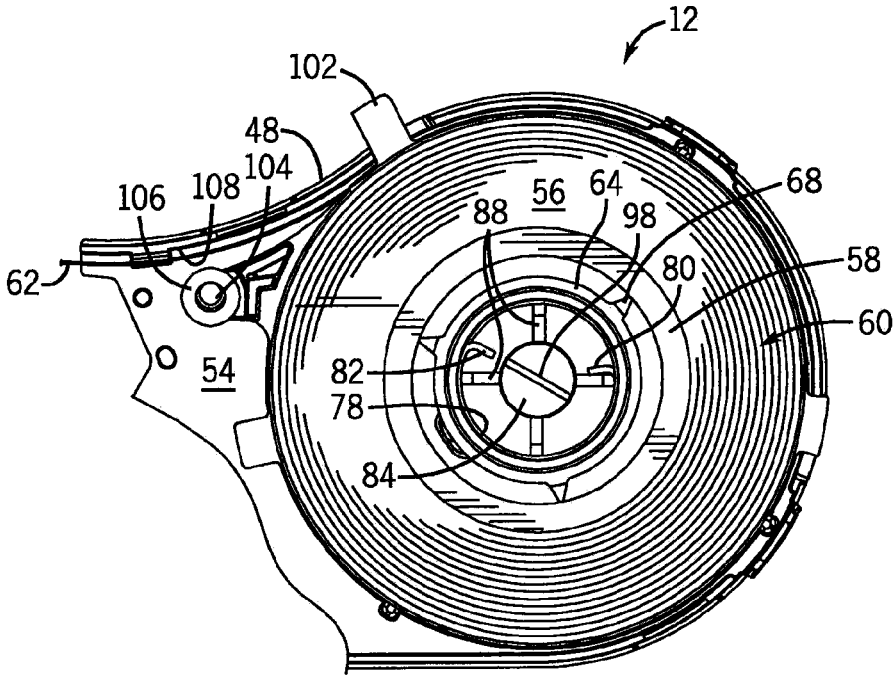
FIG. 11 is a cross-sectional top view taken through the core holder assembly.

This roll of media 60 is axially received on a core holder 64. The core holder 64 has a radially-outward facing surface 66 with three radially-extending prongs 68. The three radially extending prongs 68 are sized such that when the core 58 of the roll of media 60 is axially inserted onto the core holder 64, the prongs 68 have an interference fit with the core 58 (as best illustrated in FIG. 11). Accordingly, the core holder 64 rotates with the core 58 of the roll of media 60. The core holder 64 has also an axially-extending through hole 70 with a lower portion 72 which is of a first diameter and an upper portion 74 which is of a second diameter that is less than the first diameter. At the transition between the lower portion 72 and the upper portion 74, the core holder 64 necks down thereby providing an axially-facing stop 76.

A helically wound torsion spring 78 is received from the bottom side of the lower portion 72 of the core holder 64 and is inserted until a top end of the torsion spring 78 abuts the axially-facing stop 76. The torsion spring 78 has a diameter which is slightly larger than the diameter of the lower portion 72 of the core holder 64, such that upon insertion of the torsion spring 78 into the core holder 64, a slight interference fit occurs between the torsion spring 78 in an unstressed state and the core holder 64. Two ends 80 and 82 of the torsion spring 78 are bent radially inward towards the rotational axis of the roll of media 60.

Figure 10:
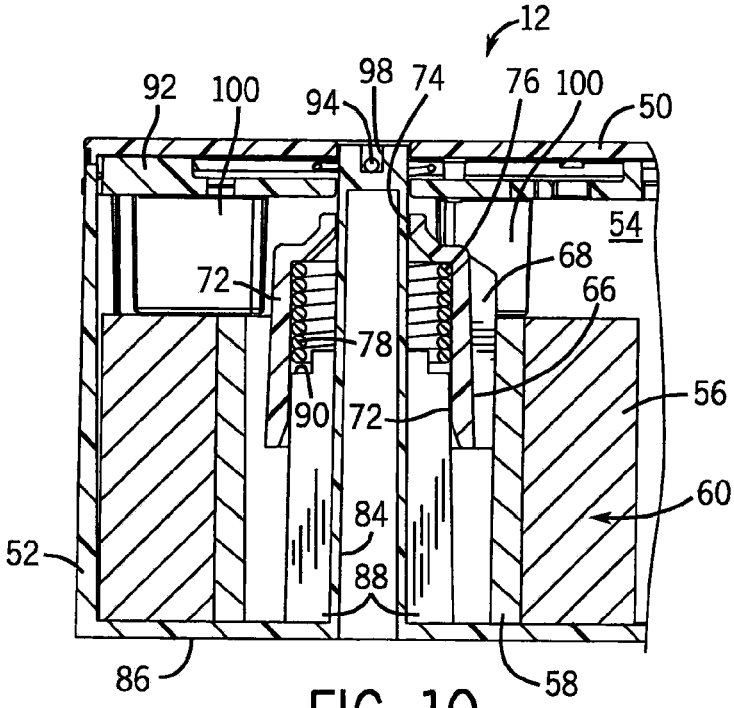
FIG. 10 is a cross-sectional side view taken through line 10-10 of FIG. 4 showing a core holder assembly.

The subassembly of the roll of media 60, the core holder 64, and the torsion spring 78 are received on a shaft 84 that extends upwardly from a floor 86 of the bottom housing portion 52. As best seen in FIGS. 10 and 11, this shaft 84 has four radially-outward extending ribs 88 or fins that run longitudinally along the shaft 84. A upward-facing step 90 is formed in each of the ribs 88 such that the portion of the rib 88 closer to the floor 86 extends radially further from the shaft 84 than the portion of the rib 88 further from the floor 86.

As best illustrated in FIG. 10, when the core holder 64 is axially received on the shaft 84, the radii of the upper and lower portions of the ribs 88 and the upward-facing step 90 between the portions of the ribs 88 are located such that the upward-facing step 90 assists in retaining the lower end of the torsion spring 78 within the through hole 70 of the core holder 64. The upper portion 74 of the core holder 64 has an inner circumference that is sized to slide over and bear on the outer circumference of the shaft 84 during the rotation of the core holder 64 around to the shaft 84. Furthermore, as best illustrated in FIG. 11, the upper portions of the ribs 88 and the lower bent-in end 80 of the torsion spring 78 are arranged such that, if the torsion spring 78 is rotated about its axis, the lower bent-in end 80 will contact a side of the upper portion of one of the ribs 88.

With reference to the top-view of the media cartridge 12 in FIG. 11, during the feeding of the length of media 56 from the roll of media 60, the roll of media 60 will rotate counter-clockwise. However, because the length of media 56 is wrapped around the core 58 when at rest, there is a tendency for the roll of media 60 to want to spin in the opposite direction, thereby unraveling the length of media 56 from the core 58. If this unraveling occurs, the length of media 56 will remain wound but, to reach a lower energy state, will loosen itself in the area around the core 58 while simultaneously causing the outer diameter of the roll to expand such that the length of media 56 packs itself against the inner walls of the housing 48.

This expansion of the roll diameter and packing against the walls is problematic. As the outermost portion of an internally unwound expanded roll of media would engage the inner walls of the housing 48, any attempt to back feed the length of media 56 would result in the frictional engagement of the roll of media 60 and the inner walls of the housing 48 and provide no room in the chamber for retraction. As this back feeding is essentially trying to add additional media length to the roll of media 60, but the internally unwound expanded roll of media has already occupied expanded to contact the inner walls of the housing 48, there would be nowhere for the back fed portion of the length of media to go. Thus, back feeding in such a condition is likely to result in jamming and bunching of the length of media 56 along the media path.

The torsion spring 78 serves as a clutch or a friction brake that prevents this kind of unraveling of the length of media 56 from the roll of media 60. The torsion spring 78 is wound to have a coiled outer surface which has a diameter that is slightly greater than the diameter of the lower portion 72 of the through hole 70 of the core holder 64. Upon initial rotation of the core holder 64, the torsion spring 78 rotates with the core holder 64 due to this interference fit between the torsion spring 78 and the core holder 64. At some point along the path of rotation, the lower bent-in end 80 contacts one of the upper portions of the ribs 88. What happens after engagement of the lower bent-in end 80 with the rib 88 will depend on the direction of rotation and the direction of winding of the torsion spring 78.

If the roll of media 60 is rotating counter-clockwise (from the top perspective of FIG. 11) when the lower bent-in end 80 of the torsion spring 78 engages the rib 88, then this engagement should induce a stress in the torsion spring 78 that will cause the diameter of the torsion spring 78 to decrease slightly (while still maintaining an interference fit with the core holder 64) such that the roll of media 60 can continue to rotate counter-clockwise, albeit under a controlled drag. The amount of drag should be sufficiently small, such that the length of media 56 does not tear during forward feeding and such that the feed mechanism will be able to provide sufficient power to continue with the forward feeding of the length of media 56.

If the core 58 of roll of media 60 is rotating clockwise (from the top perspective of FIG. 11), then this would likely be due to an unraveling force as described above. In this direction, the lower bent-in end 80 of the torsion spring 78 engages the rib 88, but the induced stress in the torsion spring 78 will cause the diameter of the torsion spring 78 to expand. As the diameter expands, the interference fit between the torsion spring 78 and the core holder 64 becomes tighter and the increased friction between the two prevents further rotation of the core holder 64 in the clockwise direction.

Thus, in the media cartridge 12, the torsion spring 78 is configured to allow the core holder 64 (and the core 58 which is connected thereto) to rotate in one direction under a controlled drag while inhibiting the substantial rotation of the core holder 64 in the opposite direction.

The materials of the core holder 64 and the torsion spring 78 should be selected with this function in mind. In one preferred form, the core holder 64 is made of an acetal or nylon material and the torsion spring 78 is made of a music wire for excellent wear control and drag consistency.

It should be appreciated that in some forms of the media cartridge 12, the core holder 64 might be eliminated as an intermediate element. In this form, the torsion spring 78 may be directly inserted into the core 58 with the components sized to achieve an interference fit similar to that described above with respect to the torsion spring 78 and the core holder 64. In this case, the frictional brake or rotational clutch will largely work the same as is described above, but it will be the interface between the core 58 and the torsion spring 78 (as opposed to between the core holder 64 and the torsion spring 78) that provides either the controlled drag or the frictional locking upon rotation.

Returning now to the general structure of the media cartridge 12, the media cartridge 12 also includes a media clutch plate 92. The media clutch plate 92 is located adjacent to the roll of media 60, is received on the top end of the shaft 84 of the bottom housing portion 52, and is rotatable about the shaft 84. On the top side of the media clutch plate 92, a biasing spring wire 94 is run between two engagement elements 96 formed in the top side of the media clutch plate 92. The biasing spring wire 94 snakes in a mirrored S-shape near the top of the shaft 84 and has a portion which runs through a slit 98 on the top of the shaft 84. Because of the manner in which the media clutch plate 92 is arranged in the media cartridge 12, the biasing spring wire 94 will tend to bias the media clutch plate 92 in a clockwise direction (as viewed from the top). On a bottom side of the media clutch plate 92, a number of spacers 100 are formed which axially space the media clutch plate 92 from the roll of media 60. On the outer periphery of the media clutch plate 92, there is an outwardly-extending tab 102 which engages a wall of the printer 10 during insertion as well as a media pinch arm 104. The media pinch arm 104 is spaced from, but extends parallel to, the axis of rotation of the media clutch plate 92 and the roll of media 60. A cylindrical sheath 106 is located on the media pinch arm 104.

When the media cartridge 12 is removed from the printer 10 for transportation or the like, the biasing spring wire 94 biases this media clutch plate 92 clockwise (as viewed from the top of the media cartridge 12) toward a pinch position (not shown) in which the cylindrical sheath 106 on the media pinch arm 104 pinches the free end 62 of the length of media 56 between the sheath 106 and an inner wall 108 of the housing 48. This prevents the free end 62 of the length of media 56 from retracting back into the internal cavity 54 of the housing 48.

When the media cartridge 12 is inserted into the printer 10, the tab 102 engages a wall of the printer 10 and is rotated counter-clockwise (again, as viewed from the top). This movement of the tab 102 causes the rotation of the media clutch plate 92 against the biasing force of the biasing spring wire 94 to an un-pinched position, as shown in FIG. 11, in which the media pinch arm 104 disengages the free end 62 of the length of media 56 such that the free end 62 can be fed through the printer 10. It should be noted that the movement to the un-pinched position will likely occur just after a nip point is formed along the media path during the loading process of the media cartridge 12 into the printer 10 so that the free end 62 of the length of media 56 is prevented at all times from retracting irretrievably into the internal cavity 54.

Figure 6:
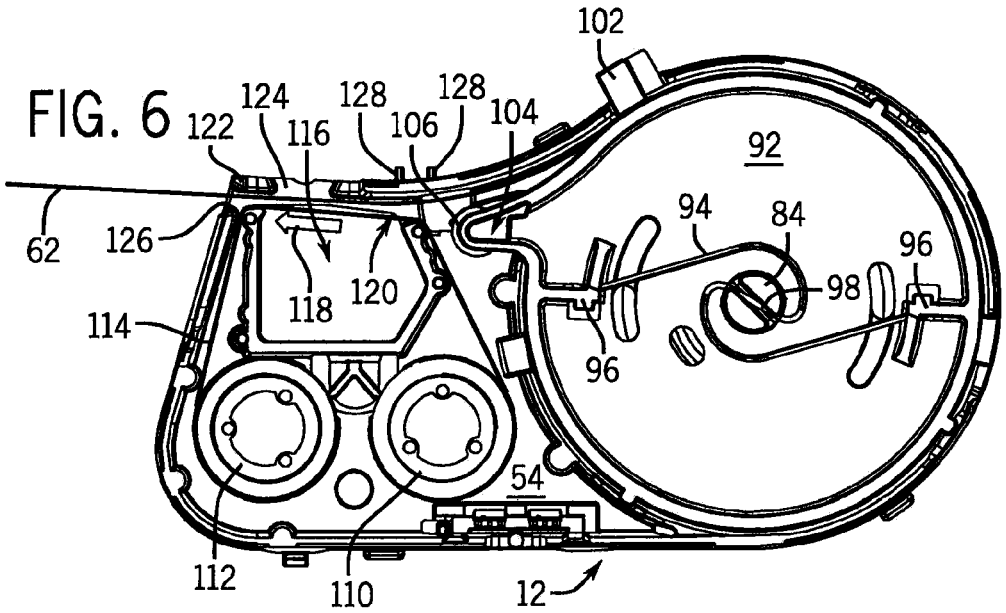
FIG. 6 is a top plan view of the media cartridge with the top portion of the housing removed.
Figure 8:
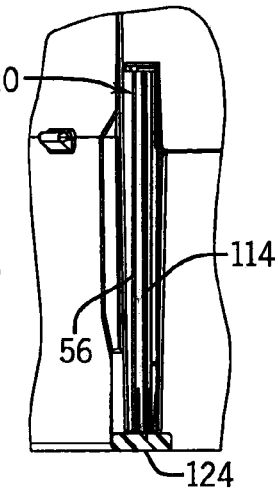
FIG. 8 is a cross-sectional view taken through line 8-8 of FIG. 4 showing a length of media, and an ink ribbon, and a corresponding edge protector of the media cartridge.
Figure 7:
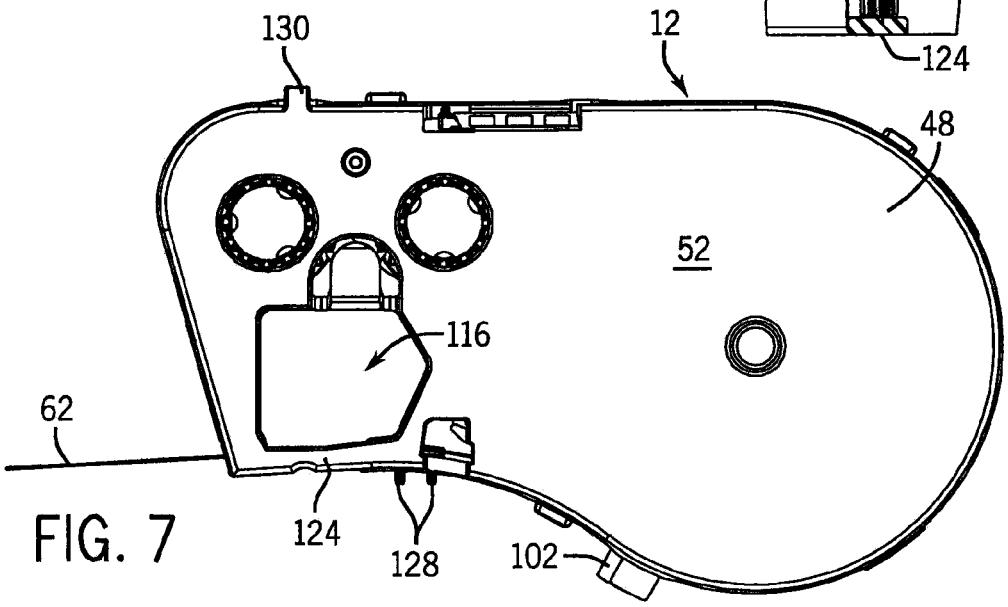
FIG. 7 is a bottom plan view of the media cartridge.

In view of that which has already been described, and with particular reference to FIG. 6, the internal cavity 54 is roughly divided into two sections. The first section of the internal cavity 54 has been described above. This first section is primarily devoted to housing the roll of media 60 and related components (i.e., the media clutch plate 92, the frictional core brake 64, etc.) for controlling the manner in which the length of media 56 is fed. The other section of the internal cavity 54 is devoted to housing two ink ribbon spools 110 and 112 that carry an ink ribbon 114, which will be described in more detail below. These two sections are arranged such that they generally bifurcate the media cartridge 12 into two sides, with the roll of media 60 on one side (the right side in FIG. 6) and the two spools 110 and 112 that carry the ink ribbon 114 on the other side (the left side in FIG. 6).

On the side of the media cartridge 12 with the two spools 110 and 112 that support the ink ribbon 114, an open space 116 extends through the cartridge housing 48 which receives the thermal print head 34 during the loading of the printer 10. On the side of the open space 116 opposite which the two spools 110 and 112 are housed, there is a media path which is generally denoted by arrow 118 in FIGS. 4 and 6. This media path 118 extends from an exit opening 120 of the internal cavity 54 to a frontal media guide 122. When loaded into the printer 10, the media path 118 is positioned such that the media path 118 runs between the thermal print head 34 and the platen roller 42.

Both the free end 62 of the length of media 56 and the ink ribbon 114 extend along the media path 118. In the case of the free end 62 of the length of media 56, the free end 62 extends from the roll of media 60 past the pinch point at the media pinch arm 104, and through the exit opening 120 of the housing 48. From there, the free end 62 passes over an edge protector 124 that is located on the bottom side of the media cartridge 12 and toward the frontal media guide 122.

With respect to the ink ribbon 114, the ink ribbon 114 loops around the outside of the of the open space 116 (albeit mostly within the internal cavity 54 of the housing 48) traversing the media path 118 along the way. The specific path of the ink ribbon 114 includes going from the supply spool 110 (which is closer to the roll of media 60 than the take-up spool 112) to the exit opening 120 of the internal cavity 54. At that point, the ink ribbon 114 meets with the length of media 56 and passes out of the exit opening 120. Along the media path 118 and over the edge protector 124, the ink ribbon 114 runs along side the length of media 56. The ink ribbon 114 is positioned closer than the length of media 56 to the open space 116 as it is this open space 116 which receives the thermal print head 34. With this positioning, the ink on the ink ribbon 114 may be directly heated for transfer to the length of media 56 during printing. At the end of the media path 118 and near the frontal media guide 122, the ink ribbon 114 splits from the path of the length of media 56 and goes into a return opening 126 of the housing 48 of the media cartridge 12. After passing through the return opening 126, the ink ribbon 114 extends through the internal cavity 54 to the take-up spool 112 that receives the ink ribbon 114 after consumption.

Notably, along the media path 118, the edge protector 124 links the housing 48 between the exit opening 120 and section of the media cartridge 12 having the frontal media guide 122 and the return opening 126, thereby bridging the two parts of the housing 48. To put it another way, the edge protector 124 extends from upstream of the print line (i.e., the point at which the thermal print head 34 and the platen roller 42 lie) to downstream at a point where the length of media 56 is separated from the ink ribbon 114. The edge protector 124 lies along a plane that is generally perpendicular to the plane of the length of media 56 and the ink ribbon 114 and is wider than the distance between the length of media 56 and the ink ribbon 114. This means that the edge protector 124 may fully span the distance between the length of media 56 and the ink ribbon 114 have a sufficient width to protect both.

It should be appreciated that in conventional media cartridges, the portions of the length of media and the ink ribbon along the media path are exposed along their bottom edges (i.e., they lack the edge protector 124 described herein). When these conventional cartridges are loaded into the printer, the media and ink ribbon are blindly threaded between the thermal print head and the platen roller. However, with the bottom edges of the ink ribbon and the media exposed, they may hit a thermal print head, a heat sink, and/or the platen roller, thereby snagging and/or damaging the media or ink ribbon.

The edge protector 124 described herein provides a shield that prevents the lower edges of the length of media 56 and the ink ribbon 114 from contacting the thermal print head 34, a heat sink, or the platen roller 42 during loading of the media cartridge 12 into the printer 10. As the platen roller 42 is retractable, even if the edge protector 124 is relatively wide, sufficient clearance can be made for the passage of the edge protector 124 during the loading operation. As will be described in more detail below with respect to the shifting ribs, the length of media 56 and the ink ribbon 114 may be urged towards the thermal print head 34 at the end of the insertion motion. Thus, to accommodate for the extra width of the edge protector 124, at the start point of insertion an increase in the spacing between the thermal print head 34 and the ink ribbon 114 may be made without significantly changing the final loaded placement of the length of media 56 and the ink ribbon 114 within the printer 10.

It should be appreciated that some or all of the edge protector 124 may be a U-shaped channel. The advantage of a U-shaped channel is that this shape protects the lower edges of the length of media 56 and the ink ribbon 114 from multiple angles including, at least to some degree, from the sides. Further, a U-shaped channel protects the length of media 56 and the ink ribbon 114 from lateral movement caused by either slack in the length of media 56 or the ink ribbon 114 or from twisting during the insertion of the media cartridge 12.

It should further be appreciated that after loading, the edge protector 124 will be lowered far enough into the cartridge receptacle 14 that, when the platen roller 42 is actuated into place, the edge protector 124 will not interfere with the printing mechanisms (i.e., either the thermal print head 34 or the platen roller 42). In some instances, this may mean that a portion of the lower margin of the length of media 56 may be inaccessible for printing, particularly if that edge is protected by a U-shaped channel near the print line. In some configurations, such as that shown, a U-shaped channel may be present at portions of the edge protector 124 upstream and downstream of the print line, but the edge protector 124 may have a flat planar shape at or around the print line (such as shown in the cross sectional view of FIG. 8). This configuration does not appreciably limit the access of the printing components to the lower portions of the length of media 56 or the ink ribbon 114.

With the overall structure of the media cartridge 12 itself having now been described, we turn to the specifics of the insertion of the media cartridge 12 into the cartridge receptacle 14. Although the general nature of the insertion of the media cartridge 12 into the cartridge receptacle 14 was depicted in FIGS. 2 and 3, we more closely examine some of the details of how the media cartridge 12 interacts with the cartridge receptacle 14 and components of the printer 10 during insertion or loading.

Figure 13:
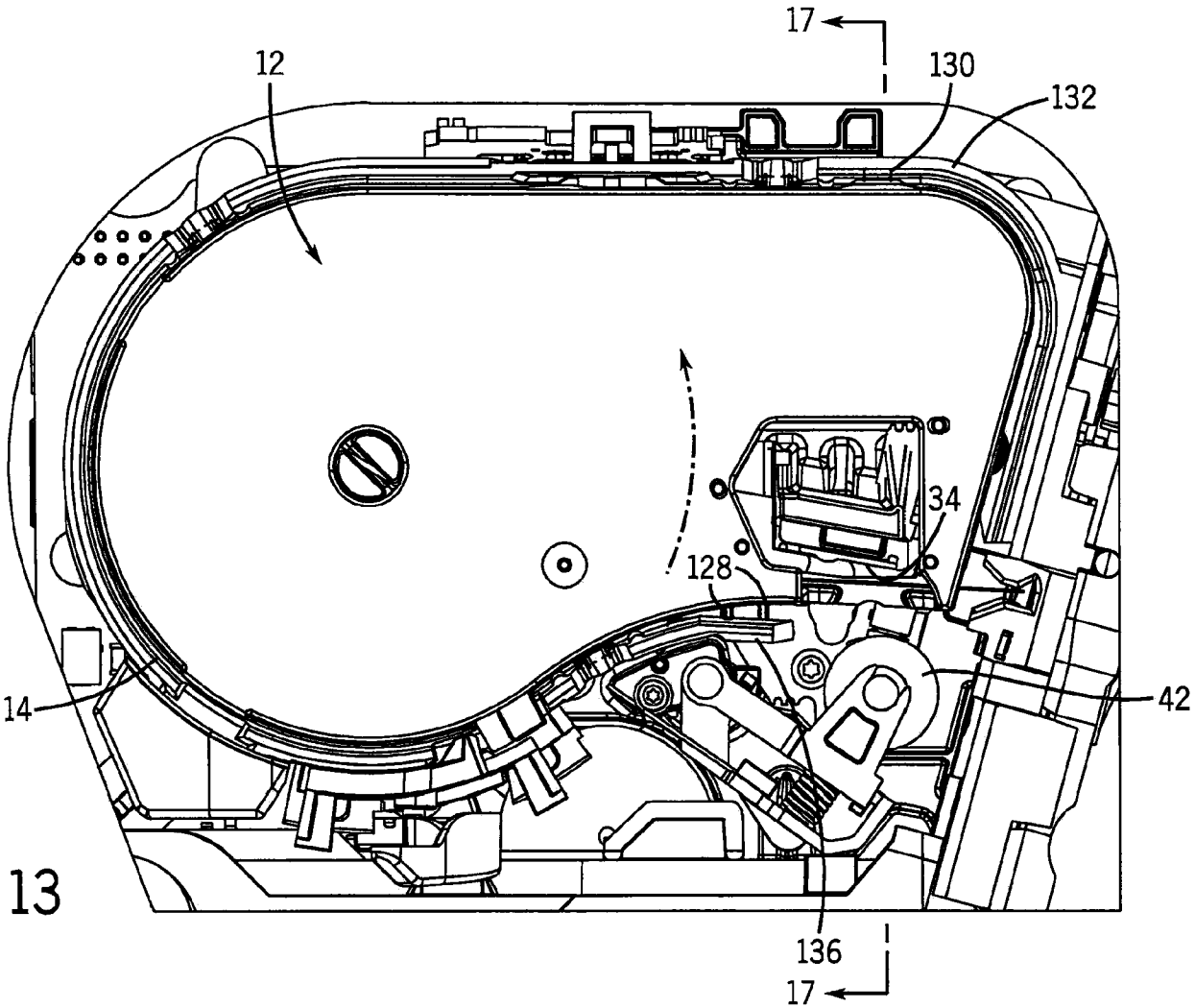
FIG. 13 is a top view of the media cartridge fully inserted into the cartridge receptacle.

Referring now to FIGS. 13 though 17, the media cartridge 12 is shown at various points during the insertion process. These figures illustrate how shifting ribs cause the rotation and/or translation of the media cartridge 12 within the cartridge receptacle 14 during insertion in directions which are generally perpendicular to the direction of insertion.

Figure 4:
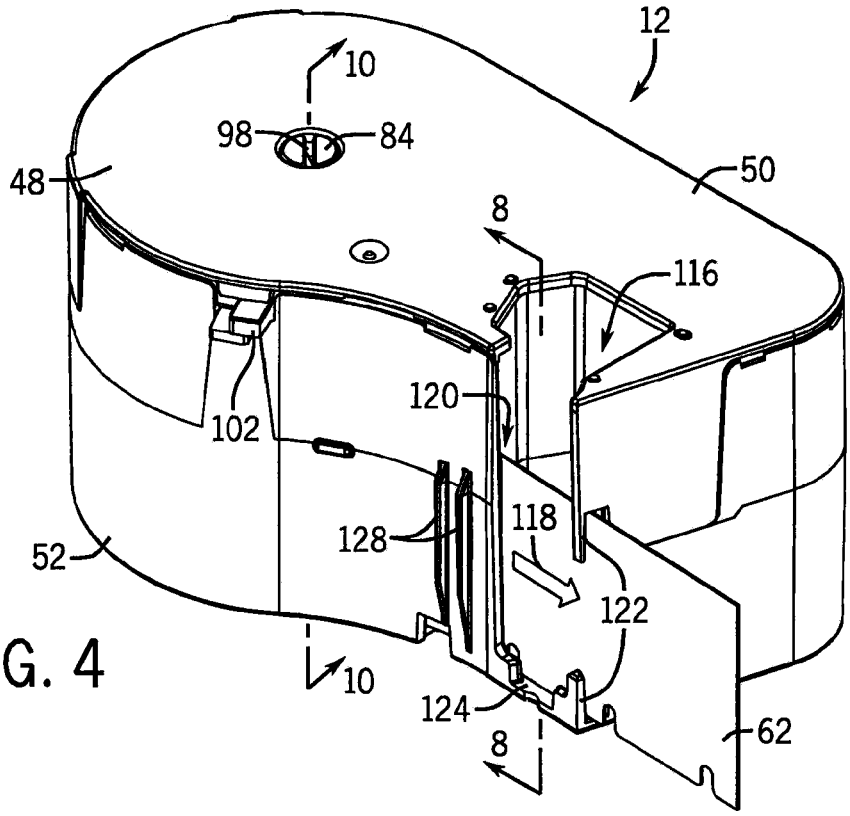
FIG. 4 is a top front side perspective view of the media cartridge of FIGS. 2 and 3 apart from the printer.
Figure 5:
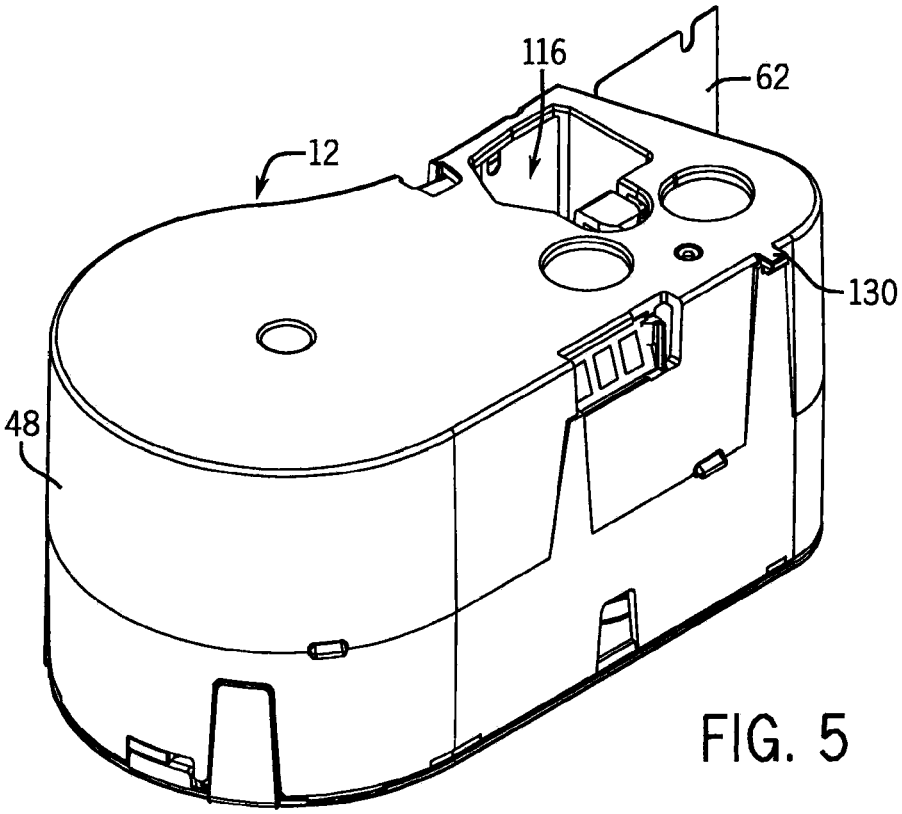
FIG. 5 is a bottom rear side perspective view of the media cartridge.

The media cartridge 12 includes shifting ribs on opposing sides of the exterior of the housing 48 proximate the end of the media cartridge 12 with the ribbon spools 110 and 112 and the open space 116. As best seen in FIG. 4, on the front side of the media cartridge 12 (i.e., the side that faces the body 16 upon insertion) there are a pair of angled ribs 128 that are formed near the bottom of the side wall of the media cartridge 12. Notably, these angled ribs 128 are beveled such that a leading lower edge of each angled rib 128 bevels outward as the ribs 128 extend upwardly on the media cartridge 12 and then forms to a flat portion that is generally parallel with the side wall of the media cartridge 12. As best seen in FIG. 5, on the back side of the media cartridge 12 (i.e., the side that faces away from the body 16 upon insertion) there is another shifting rib in the form a tab 130 that extends outwardly from the side wall and is also flush with the bottom face of the media cartridge 12.

The interaction of the angled ribs 128 and the tab 130 with the walls of the cartridge receptacle 14 will now be described with reference to FIGS. 12 through 17.

Figure 12:
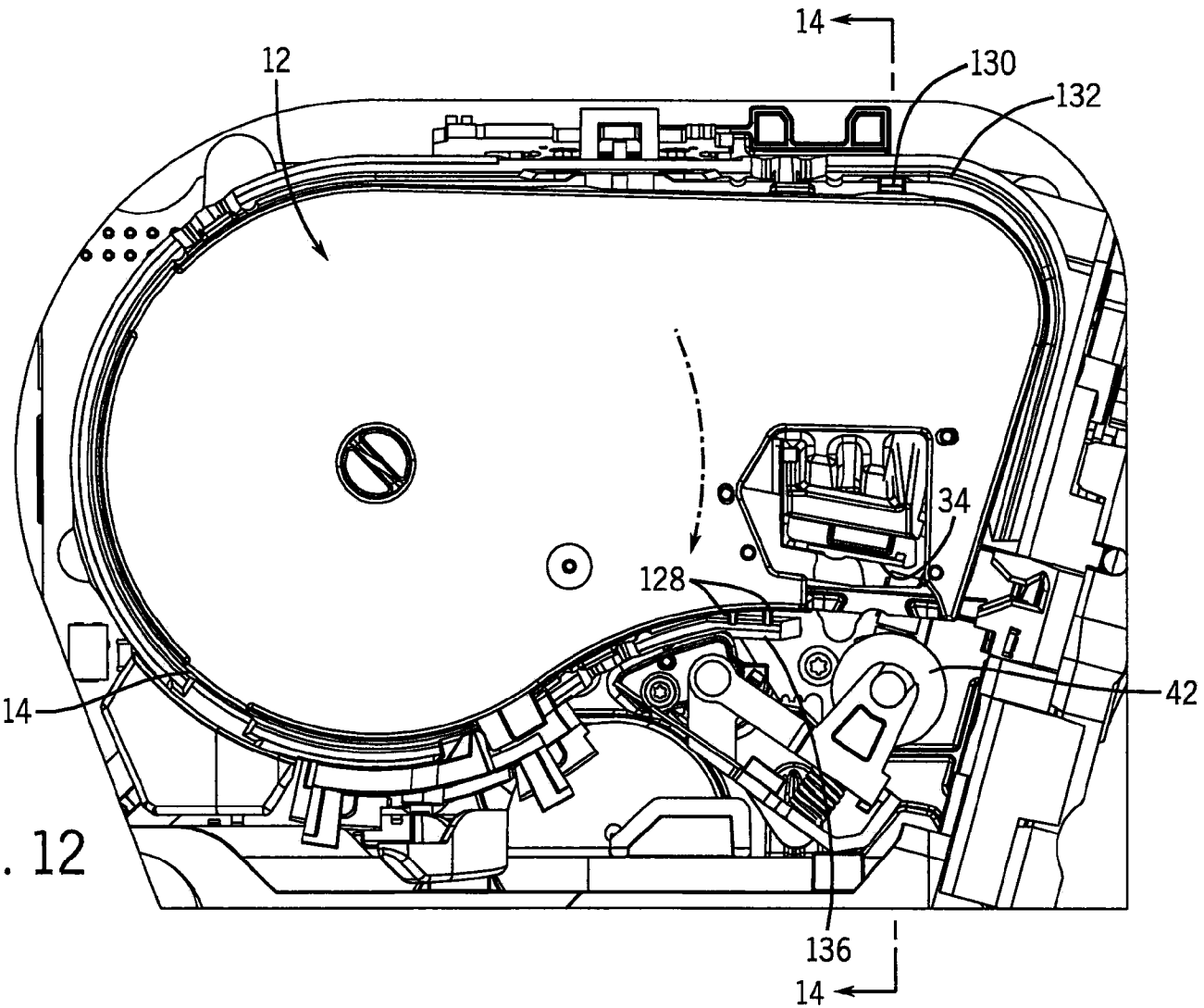
FIG. 12 is a top view of the media cartridge at an initial point of insertion into the cartridge receptacle.
Figure 14:
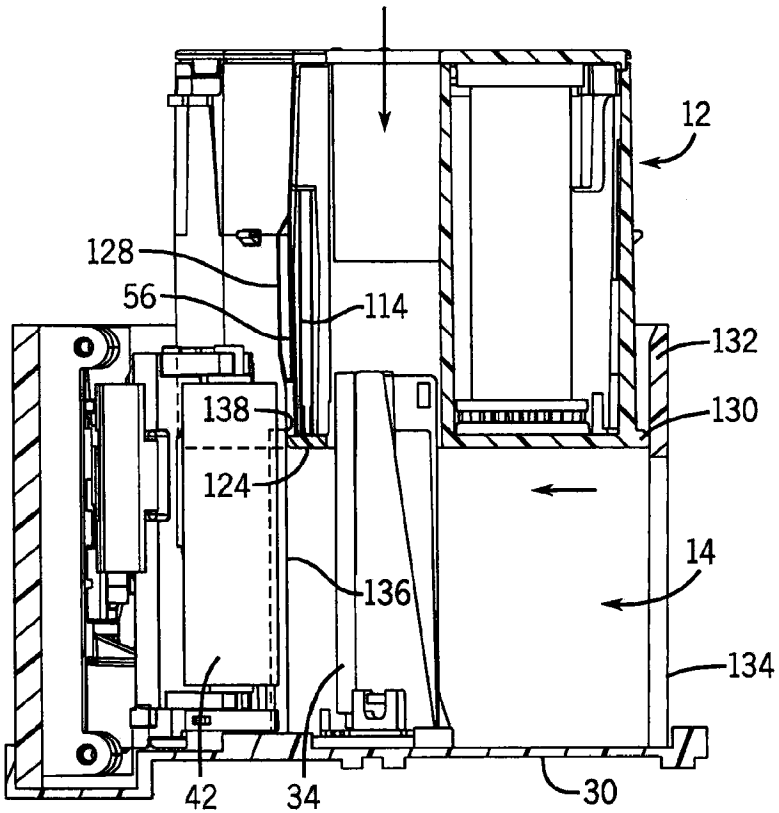
FIG. 14 is a cross-sectional side view taken through line 14-14 of FIG. 12, illustrating a first point of insertion of the media cartridge into the cartridge receptacle, at which point the length of media and the ink ribbon are centered between the print head and the platen roller.

At the point of initial insertion, which is depicted in FIGS. 12 and 14, the tab 130 on the back side of the media cartridge 12 interacts with a rear wall 132 of the cartridge receptacle 14. The tab 130 is positioned to align with a slot 134 formed in the lower end of the rear wall 132, although at this point the tab 130 is still too far up the rear wall 132 to engage the slot 134. As the dotted arrow in FIG. 12 indicates, this interference between the tab 130 and the rear wall 132 forces the right end of the media cartridge 12 to be shifted downward as viewed from the top side perspective shown in FIG. 12 or leftward from the side depiction of FIG. 14. As best seen in FIG. 14, this has the practical effect of centering the edge protector 124, the length of media 56, and the ink ribbon 114 between the thermal print head 34 and the platen roller 42. Accordingly, the edge protector 124, the length of media 56, and the ink ribbon 114 are initially forced to a location in which they are unlikely to contact the components of the printer 10 including the thermal print head 34 and the platen roller 42. At this point in the insertion, the angled ribs 128 have not yet engaged a front wall 136 of the cartridge receptacle 14.

Figure 15:
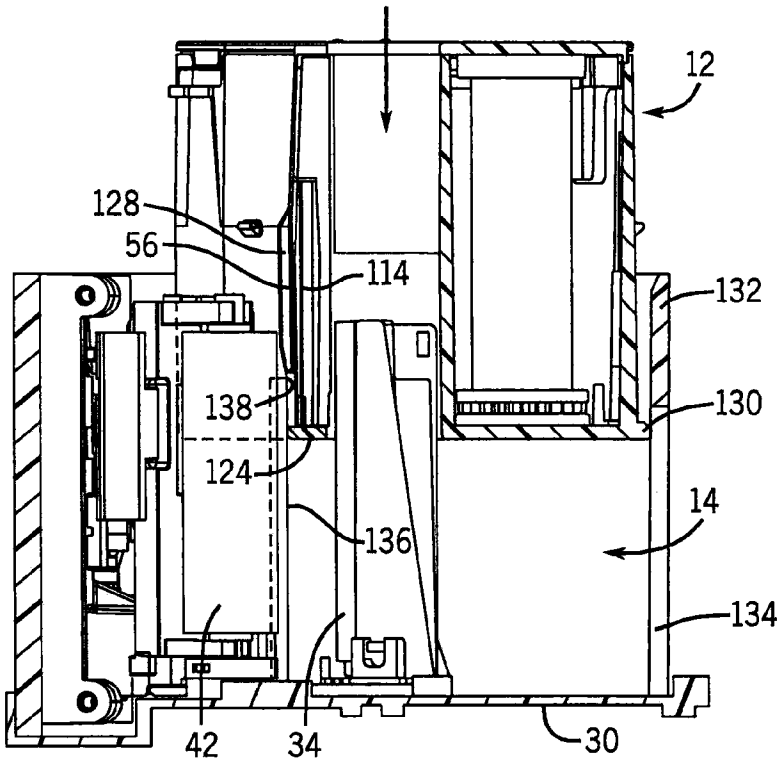
FIG. 15 is a cross-sectional side view showing further insertion to a point at which the tab on the media cartridge has reached the top of a slot in the cartridge receptacle, but prior to the engagement of the angled ribs on the other side of the media cartridge with the opposing wall of the cartridge receptacle to bias the media and the ink ribbon toward the print head.

As depicted in FIG. 15, the media cartridge 12 continues to be inserted downward in the cartridge receptacle 14 until the tab 130 reaches the top of the slot 134 in the rear wall 132 of the cartridge receptacle 14. After the media cartridge 12 is inserted to the point at which tab 130 is at or below the top of the slot 134, the media cartridge 12 has the ability to shift rightward relative to the view of FIG. 15 (or upward if viewed from a top view such as in FIG. 13). Notably, at this point during the insertion, the angled ribs 128 are at location just above a top edge 138 of the front wall 136 of the cartridge receptacle 14, but the angled ribs 128 have not yet interacted with the top edge 138 of the front wall 136. At least in the form shown, until the tab 130 can engage or be displaced into the slot 134, the angled ribs 128 should not engage the top edge 138 which would force the media cartridge 12 to shift over.

Figure 16:
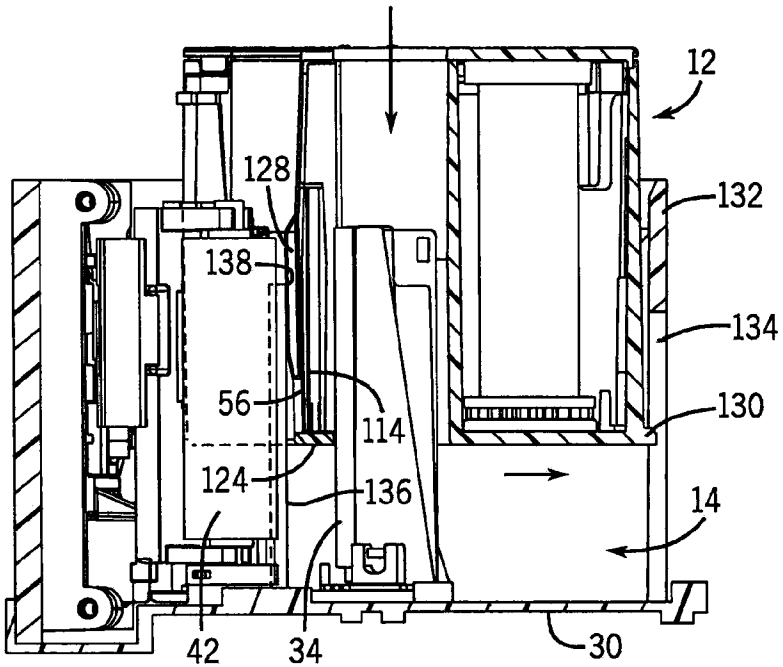
FIG. 16 is a cross-sectional side view at still a further point of insertion in which the angled ribs have biased the media and the ink ribbon toward the print head.

Upon further insertion to the location depicted in FIG. 16, the interaction of the angled ribs 128 with the top edge 138 of the front wall 136 causes the media cartridge 12 to shift rightward (from the side perspective of FIG. 16). At this point, the angled ribs 128 have interacted with the top edge 138 of the front wall 136, causing the tab 130 to move into the slot 134 formed in the rear wall 132 and, further, causing the urging or biasing the length of media 56 and the ink ribbon 114 towards the thermal print head 34. It should be noted that this shifting may be a rotation of the media cartridge 12 relative to a fixed axis (such as if the shaft 84 mates with a spindle on the other end of the media cartridge 12 during insertion), a translation of the media cartridge 12 within the cartridge receptacle 14, or a combination of both rotation and translation.

Figure 17:
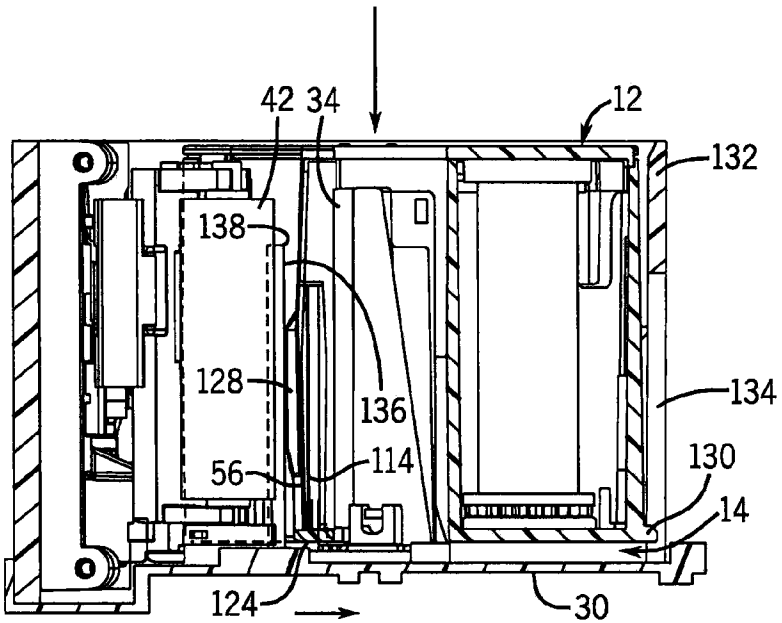
FIG. 17 is a cross-sectional side view taken through line 17-17 of FIG. 13 of a point of full insertion of the media cartridge into the cartridge receptacle.

Finally, as depicted in FIGS. 13 and 17, the media cartridge 12 is fully inserted into the cartridge receptacle 14. At this point, the media cartridge 12 may be temporarily locked into the cartridge receptacle 14 to prevent the media cartridge 12 from falling out. The locking mechanism (not shown) may be part of the printer 10 and, in any event, should allow the media cartridge 12 to be removed when the media cartridge 12 is fully consumed. Now that the cartridge is fully inserted, a portion of the media cartridge 12 may interact with the printer 10 to cause the actuation of the platen roller 42 towards the thermal print head 34 to create a nip point and a print line along the media path 118. The creation of a nip point at this stage in the insertion or just before this stage of the insertion is valuable because the tab 102 of the media clutch plate 92 will unpinch or release the length of media 56 as that tab 102 also interacts with the printer 10 during loading.

It should be appreciated that, while the insertion has been described with the length of media 56 and the ink ribbon 114 being biased or urged towards a stationary thermal print head 34 with the platen roller 42 being moved toward the thermal print head 34, that this configuration could be reversed. For example, the platen roller could be a stationary object and, during insertion, the length of media and the ink ribbon could be urged or biased toward the platen roller. In that configuration, the thermal print head would be movable toward the fixed platen roller to form the nip point and the print line.

Among other things, these shifting ribs allow the media cartridge 12 to be directed within the cartridge receptacle 14 in such a way as to (1) initially center the length of media 56 and the ink ribbon 114 with respect to the thermal print head 34 and the platen roller 42, thereby avoiding contact with them and potential damage to the length of media 56 and the ink ribbon 114, and (2) during further insertion, urge or bias the length of media 56 and the ink ribbon 114 into place against the thermal print head 34 or the platen roller 42. Moreover, the shifting ribs cause only a gradual shifting of the media cartridge 12 over the distance of insertion. Thus, the shifting is not greatly apparent to the user performing the insertion and no thought need be given to the task of threading the length of media 56 and the ink ribbon 114 between the printer components by the user.

Now with reference to FIGS. 18 through 24, a mechanism is described for locking and unlocking the ink ribbon spools 110 and 112 of the media cartridge 12. This mechanism is constructed such that, like the shifting ribs described above, the locking and unlocking occurs during the insertion and/or the removal of the media cartridge 12 into the cartridge receptacle 14.

Figure 18:
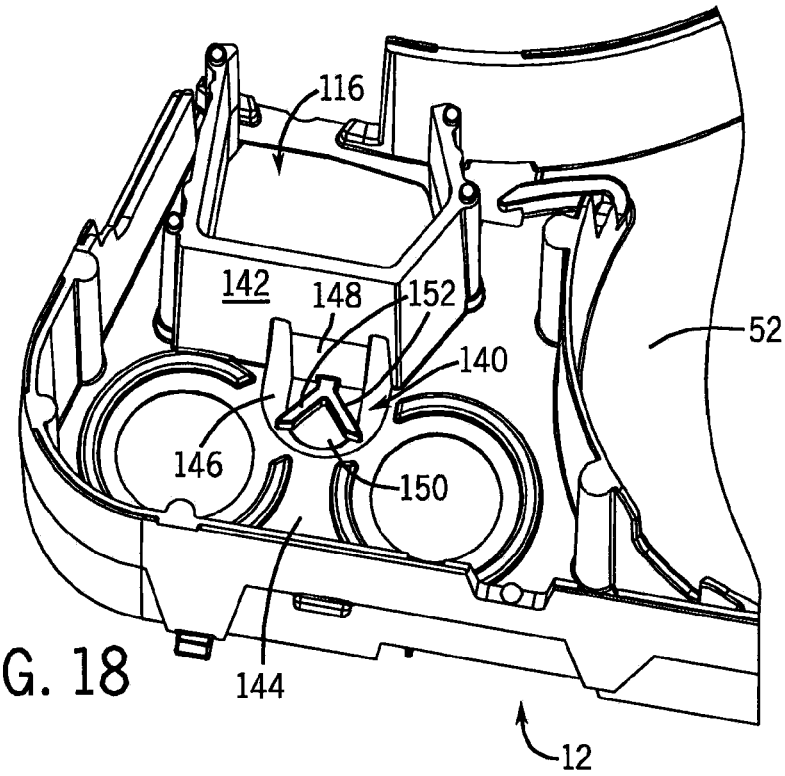
FIG. 18 is a detailed perspective view of the ribbon lock member of the cartridge housing with the ink ribbon spools removed.
Figure 19:
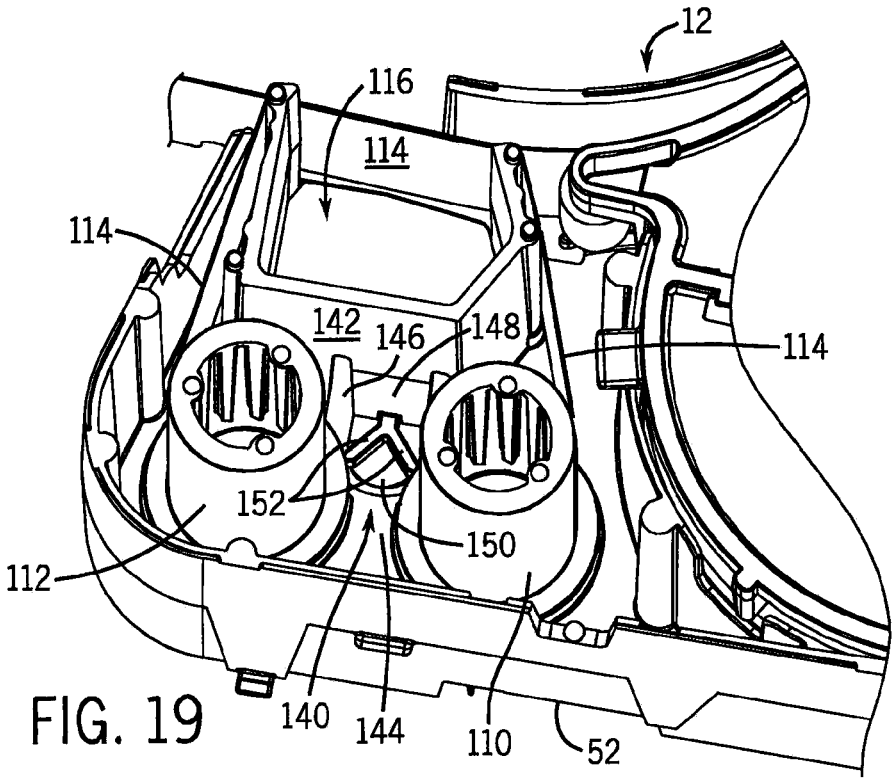
FIG. 19 is a view similar to FIG. 18, but also including the ink ribbon spools.

Looking first at the media cartridge 12, a ribbon lock member 140 is integrally formed with the cartridge housing 48. As best seen in FIG. 18, the ribbon lock member 140 is formed in the bottom housing portion 52 in a side wall 142 that defines a portion of the open space 116 and a bottom wall 144. This ribbon lock member 140 has a U-shaped cutout 146 defining its periphery with the two straight portions of the U being formed in the side wall 142 and the rounded portion of the U being formed in the bottom wall 144. This means that the ribbon lock member 140 is generally L-shaped having a generally vertical portion 148 that is formed in the side wall 142 and a generally horizontal portion 150 that is formed in the bottom wall 144 with the portions joined at a bend. The generally horizontal portion 150 of the ribbon lock member 140 extends toward a central location between the two ink ribbon spools 110 and 112 as best depicted in FIG. 19. Further, the generally horizontal portion 150 of the ribbon lock member 140 has a beveled or angled surface 162 formed on the end and bottom side of the ribbon lock member 140.

A pair of prongs 152 or legs are formed on the top side of the generally horizontal portion 150 of the ribbon lock member 140 on the inside of the cartridge housing 48. The pair of prongs 152 extend in a direction that is generally parallel to the bottom wall 144 of bottom housing portion 52 and fork from a Y-shape. As depicted in FIG. 20, each of the pair of prongs 152 extend towards one of the ink ribbon spools 110 and 112 and have tips 154 that are positioned to engage teeth 156 formed on a circumference of the base of the ink ribbon spools 110 and 112. When the tips 154 of the prongs 152 engage the teeth 156 on the ink ribbon spools 110 and 112, the ink ribbon spools 110 and 112 are prevented from rotating, thereby preventing the shifting or unraveling of the ink ribbon 114.

The ribbon lock member 140 is made of an elastically flexible material such that the ribbon lock member 140 may be deflected away from the ink ribbon spools 110 and 112. A deflection of this type, as will be described in more detail below, will disengage the tips 154 of the prongs 152 from the teeth 156 of the ink ribbon spools 110 and 112 thereby unlocking the ink ribbon spools 110 and 112 and allowing their free rotation as well as the feeding of the ink ribbon 114 between them. Although in the form shown and described, unlocking the spools 110 and 112 allows their free rotation either clockwise or counter-clockwise, it is contemplated that in some forms, the spools may include a clutch that only allows a single direction of rotation or feeding under a controlled drag such as was described above with respect to the friction brake on the core holder 64.

Notably, if the ribbon lock member 140 engages the teeth 156 of the spools 110 and 112, in the event that the ink ribbon 114 is pulled from one or both of the spools 110 and 112, then the prongs 152 will only dig deeper into the teeth 156 of the spools 110 and 112. This means that when the media cartridge 12 is outside of a printer 10 for transport or the like, and the ribbon lock member 140 is unflexed and engages the teeth 156, the ink ribbon 114 is prevented from unraveling from one or both of the spools 110 and 112.

With specific reference to FIG. 21, the portion of the cartridge receptacle 14 that receives the ribbon lock member 140 and the ink ribbon spools 110 and 112 is illustrated. Various elements extend upwardly from the base wall 30 including the thermal print head 34, a pair of ribbon drive spindles 36 onto which the ink ribbon spools 110 and 112 are loaded, and an unlocking post 38 between the ribbon drive spindles 158. The unlocking post 38 is positioned between the two rotational centers of the ribbon drive spindles 36, but is offset in a direction toward the thermal print head 34. At the top of the unlocking post 38 there is a beveled or angled surface 164 which generally faces away from the ribbon drive spindles 36 and towards the thermal print head 34.

Figure 22:
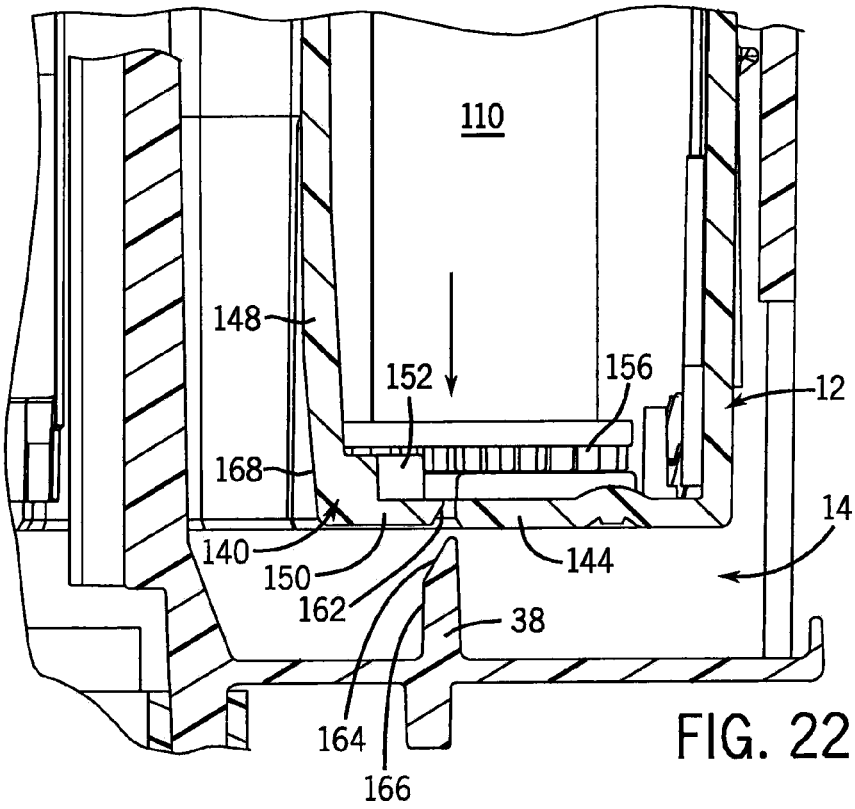
FIG. 22 is a cross-sectional side view taken during the insertion of the media cartridge into the cartridge receptacle just prior to the unlocking post engaging the ribbon lock member.
Figure 23:
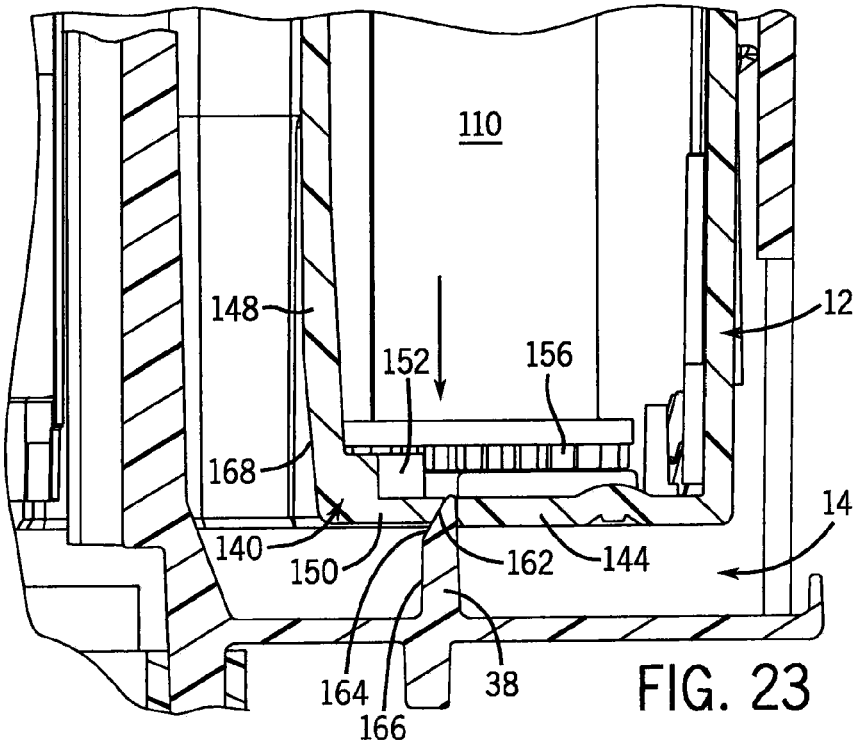
FIG. 23 is a cross-sectional side view similar to FIG. 22, but at a point of initial engagement between the angled surface of the ribbon lock member and the angled surface of the unlocking post.
Figure 24:
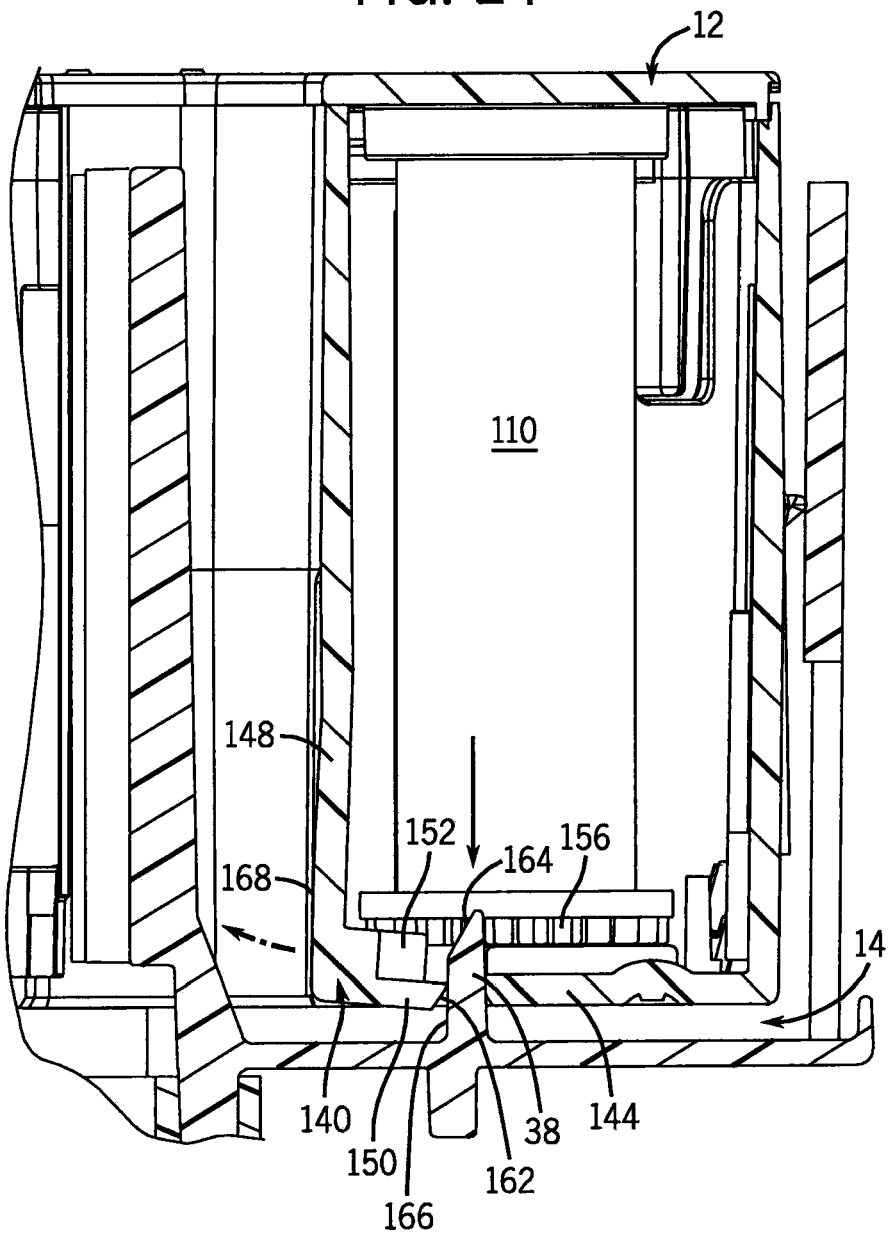
FIG. 24 is a cross-sectional side view after the full insertion of the media cartridge into the cartridge receptacle in which the unlocking post has flexed the ribbon lock element outward to unlock the ink ribbon spools.

Now with reference to FIGS. 22 through 24, the media cartridge 12 is shown at various points during loading into the cartridge receptacle 14. During this loading, the unlocking post 38 flexes the ribbon lock member 140 away from the ink ribbon spools 110 and 112 to unlock the spools 110 and 112 and thereby allowing the ink ribbon 114 to be fed by the ribbon drive spindles 36.

In FIG. 22, the media cartridge 12 is shown partially inserted into the cartridge receptacle 14. At this point, the unlocking post 38 has not yet engaged the ribbon lock member 140. Accordingly, the tips 154 of the prongs 152 of the ribbon lock member 140 continue to engage the teeth 156 of the ink ribbon spools 110 and 112.

As depicted in FIG. 23, as the media cartridge 12 continues to be loaded into the cartridge receptacle 14, the angled surface 164 of the unlocking post 38 contacts the angled surface 162 of the ribbon lock member 140. At this point of the insertion, the unlocking post 38 wedges itself between the end of the generally horizontal portion 150 of the ribbon lock member 140 and the bottom wall 144 of the media cartridge 12.

Upon further insertion, as shown in FIG. 24, the unlocking post 38 wedges the ribbon lock member 140 outward relative to the internal cavity 54 thereby unlocking the ink ribbon spools 110 and 112. The outward deflection of the ribbon lock member 140 is caused by the sliding of the angled surface 162 of the ribbon lock member 140 past the angled surface 164 of the unlocking post 38. After the point at which the angled surfaces 162 and 164 have fully slid past one another, the end of the ribbon lock member 140 slides down a generally vertical planar outer surface 166 of the unlocking post 38. During this outward deflection of the ribbon lock member 140, the tips 154 of the prongs 152 of the ribbon lock member 140 are swung down and away from the teeth 156 of the ink ribbon spools 110 and 112, thereby disengaging the teeth 156. This unlocks the ink ribbon spools 110 and 112, meaning that they may now be freely rotated using the ribbon drive spindles 36.

As best seen in FIGS. 23 and 24, there is sufficient clearance below and behind the ribbon lock member 140 such that this outward flexure does not interfere with any other components, including the thermal print head 34. The ribbon lock member 140 may also have a tapered surface 168 on the back side of the generally vertical portion 148 so as to reduce the clearance space needed to allow for the deflection.

Notably, the material forming the ribbon lock member 140 is elastically deformable (at least within the depicted flexure range). Thus, when the media cartridge 12 is removed from the cartridge receptacle 14, the ribbon lock member 140 is able to flex back toward the ink ribbon spools 110 and 112 and the tips 154 of the prongs 152 may re-engage the teeth 156 of the spools 110 and 112 to lock their rotation. The ribbon lock member 140 must be rigid enough to maintain engagement with the teeth 156 during vibration, transportation, and dropping of the media cartridge 12, while also being flexible enough to disengage relatively easy during the insertion of the media cartridge 12. Accordingly, selecting the right material requires a balancing of these considerations. The mechanical properties also depend on a number of factors such as, for example, the wall thickness of the ribbon lock member 140, which could also be altered in view of the material fabricating the housing 48.

It will be appreciated that while the ribbon lock member 140 has been described with reference to ink ribbon spools, that a similar deflectable locking member could be used in other applications, such as the locking of a media spool.

Of course, there are a number of benefits which are achieved by the structure described above, including the simultaneous unlocking of two spools by a single member. Further, the locking and unlocking of the spools 110 and 112 occurs automatically during insertion or removal of the media cartridge 12 into the cartridge receptacle 14 with no additional action by the user.

Further, as the ribbon lock member 140 flexes outwardly and downwardly, the ribbon lock member 140 is displaced without generating an upward force on the media cartridge 12 that could dislodge the media cartridge 12 from the cartridge receptacle 14. Although a ribbon lock member that flexes upwardly could be used to provide a locking/unlocking mechanism, the design of the printer assembly might need to be changed in order to retain the cartridge within the cartridge receptacle.

This design not only prevents the ink ribbon 114 from unwinding by use of the ribbon lock member 140, but provides a ratchet system that allows a user to take up the slack in the ink ribbon 114. By positioning the prongs 152 of the ribbon lock member 140 and teeth 156 of the spools 110 and 112 appropriately, the media cartridge 12 is configured such that, when the ribbon lock member 140 is in the engaged position, the spools 110 and 112 cannot be rotated in a direction that causes unraveling of the ink ribbon 114 as described above (from the top perspective of FIG. 19, the unraveling direction of rotation is a counter-clockwise direction for the spool 110 and a clockwise direction for the spool 112). However, the positioning of the spools 110 and 112 and the ribbon lock member 140 still permits the rotation of the spools 110 and 112 in a ratcheting direction opposite the direction that the spools 110 and 112 rotate during unraveling, thereby allowing the spools 110 and 112 to be rotated in such a manner as to take up slack in the ink ribbon 114. As the ribbon lock member 140 is centrally located between the two spools 110 and 112 and the prongs 152 of the ribbon lock member 140 extend outwardly at an angle from one another, the angle of separation can be selected and the tips 154 positioned for engagement with the teeth 156 such that, even when the ribbon lock member 140 is engaged position, the teeth 156 of the spools 110 and 112 can slide past the tips 154 when the spools 110 and 112 rotate in a ratcheting direction to take up slack in the ink ribbon 114. However, in the other direction of rotation (i.e., the unraveling direction), the tips 154 dig into the teeth 156 to prevent rotation when the spools 110 and 112 rotate. Accordingly, to remove slack, the user may manually rotate the spools 110 and 112 in the ratcheting direction or a device may be configured to twist the spools 110 and 112 in the ratcheting direction to achieve the same effect.

Many modifications and variations to this preferred embodiment will be apparent to those skilled in the art, which will be within the spirit and scope of the invention. Therefore, the invention should not be limited to the described embodiment. To ascertain the full scope of the invention, the following claims should be referenced.

What is claimed is:

1. A printer assembly comprising:

a printer having a print head and a platen roller located therein and a cartridge receptacle including a wall; and a media cartridge loaded into the cartridge receptacle of the printer, the media cartridge including a cartridge housing having an exit opening and a front guide, a length of media supported by the cartridge housing and having a portion that extends from the exit opening to the front guide along a media path, an ink ribbon supported by the cartridge housing and having a portion that runs parallel to the length of media along the media path, and at least one shifting rib formed on the cartridge housing;

wherein the at least one shifting rib centers a length of media and an ink ribbon between the print head and the platen roller in the cartridge receptacle at a position of initial insertion of the media cartridge into the cartridge receptacle and, when loaded into the cartridge receptacle, shifts the length of media and the ink ribbon toward one of the print head and the platen roller by interacting with the wall of the cartridge receptacle of the printer to cause a rotation of the cartridge about an axis parallel to a direction of loading.

2. The printer assembly of claim 1, wherein the at least one shifting rib is a tab that engages a corresponding slot formed at a lower end of a wall of the cartridge receptacle and wherein, during insertion, an interaction of the tab with the wall of the cartridge receptacle above the slot initially centers the length of media and the ribbon between the platen roller and the print head before the tab engages the slot and, after a position of insertion at which the tab engages the slot, an engagement of the tab with the slot permits shifting of the length of media and the ribbon toward one of the print head and the platen roller.

3. The printer assembly of claim 1, wherein one of the print head and the platen roller are movable and the other is fixed and such that, once the media cartridge is loaded into the cartridge receptacle, the movable one of the print head and the platen roller is moved towards the fixed one of the print head and the platen roller to form a nip point.

4. The printer assembly of claim 1, wherein the direction of loading of the media cartridge into the cartridge receptacle is downward into the cartridge receptacle, the direction of loading being generally perpendicular to a direction of shift of the media and ink ribbon between the position of initial insertion and a position after the media cartridge is fully inserted into the cartridge receptacle.

5. The printer assembly of claim 1, wherein the media cartridge includes two shifting ribs that are positioned on opposite sides of the media cartridge and that are positioned to engage the sidewall of the cartridge receptacle at different positions over a length of insertion of the media cartridge into the cartridge receptacle, thereby resulting in a movement of the media cartridge relative to the cartridge receptacle perpendicular to the direction of insertion over the length of insertion.

6. The printer assembly of claim 1, wherein the at least one shifting rib is positioned the cartridge housing on an end of the media cartridge from which the media is dispensed.

* * * * *